US006311034B1

(12) United States Patent
Nakashima et al.

(10) Patent No.: US 6,311,034 B1
(45) Date of Patent: Oct. 30, 2001

(54) WET TYPE ELECTROPHOTOGRAPHY APPARATUS TO EVENLY APPLY DEVELOPING SOLUTION ON A DEVELOPING ROLLER

(75) Inventors: Yutaka Nakashima, Kanazawa; Akihiko Inamoto, Uchinada-machi; Shigrki Uesugi, Unoke-machi; Satoru Moto, Kanazawa; Motoharu Ichida, Tsubata-machi; Masanari Takabatake, Kanazawa; Shigeharu Okano, Hakui; Seiichi Takeda, Kanazawa, all of (JP)

(73) Assignee: PFU Limited, Ishikawa (JP)

( * ) Notice: Subject to any disclaimer, the term of this patent is extended or adjusted under 35 U.S.C. 154(b) by 0 days.

(21) Appl. No.: 09/284,737

(22) PCT Filed: Aug. 27, 1998

(86) PCT No.: PCT/JP98/03802

§ 371 Date: Jun. 24, 1999

§ 102(e) Date: Jun. 24, 1999

(87) PCT Pub. No.: WO99/10779

PCT Pub. Date: Mar. 4, 1999

(30) Foreign Application Priority Data

| | | |
|---|---|---|
| Aug. 27, 1997 | (JP) | 9-230133 |
| Aug. 27, 1997 | (JP) | 9-230134 |
| Dec. 17, 1997 | (JP) | 9-347391 |
| Mar. 10, 1998 | (JP) | 10-057612 |

(51) Int. Cl.[7] ..... G03G 15/10
(52) U.S. Cl. ..... 399/239
(58) Field of Search ..... 399/237, 239, 399/240, 249

(56) References Cited

U.S. PATENT DOCUMENTS

| | | | | |
|---|---|---|---|---|
| 3,084,043 | * | 4/1963 | Gundlach | 399/237 X |
| 3,667,428 | * | 6/1972 | Smith | 399/239 |
| 4,400,079 | * | 8/1983 | Landa | 399/240 |
| 5,432,591 | * | 7/1995 | Geleynse | 399/237 |
| 5,521,685 | * | 5/1996 | Barnes et al. | 399/249 |
| 5,826,145 | * | 10/1998 | Fukae | 399/237 X |
| 5,826,148 | * | 10/1998 | Iino et al. | 399/240 |
| 6,029,036 | * | 2/2000 | Itaya et al. | 399/239 |

FOREIGN PATENT DOCUMENTS

| | | |
|---|---|---|
| 55-33155 | 3/1980 | (JP) . |
| 63-180867 | 11/1988 | (JP) . |
| 4-247472 | 9/1992 | (JP) . |
| 6-19326 | 1/1994 | (JP) . |
| 6-222677 | 8/1994 | (JP) . |
| 7-152257 * | 6/1995 | (JP) . |
| 8-137279 | 5/1996 | (JP) . |
| 8-297417 | 11/1996 | (JP) . |
| 8-328388 | 12/1996 | (JP) . |
| 8-328392 | 12/1996 | (JP) . |

* cited by examiner

*Primary Examiner*—Fred L. Braun

(57) ABSTRACT

A wet type electrophotography apparatus including a non-volatile, high-viscosity, high-concentration liquid toner as a developing solution. The wet type electrophotography apparatus includes a photoconductive medium on which an electrostatic latent image is formed, a prewetting device for applying a film of a prewetting solution to the surface of the photoconductive medium, a developing device including a developing roller, and a developing solution applying device for applying a film of the developing solution on the developing roller. The developing roller feeds the developing solution to the photoconductive medium by making contact with the photoconductive medium, and causes toner particles in the developing solution to deposit on an image carrier in accordance with an electrical field formed between the developing roller and the photoconductive medium. The developing solution applying device includes a plurality of interconnecting rotating rollers for transporting the developing solution while spreading and applying it on the surface with the rotating rollers, and applies a film of the developing solution on the surface of the final-stage rotating roller in accordance with an electrical field formed between the final-stage rotating roller and the developing roller by a bias voltage fed to the final-stage rotating roller.

28 Claims, 21 Drawing Sheets

Relationship between toner apparent viscosity and shearing speed

WET TYPE ELECTROPHOTOGRAPHY APPARATUS TO EVENLY APPLY DEVELOPING SOLUTION ON A DEVELOPING ROLLER

BACKGROUND OF THE INVENTION

1. Field of the Invention

This invention relates generally to a wet type electrophotography apparatus using a non-volatile, high-viscosity liquid toner, and more particularly to a wet type electrophotography apparatus in which blush-free, high-quality images can be developed by feeding and applying a developing solution evenly onto a developing roller and applying a film of prewetting solution evenly onto a photoconductive medium, and a residual toner layer on the developing roller after development can be stably recovered.

2. Description of the Related Art

As for electrophotography apparatus in which an electrostatic latent image is formed on a photoconductive medium (photoconductive drum), a toner is caused to adhere to the charged image, and the powder image is then transferred and thermally fixed onto a printing medium, such as paper, the dry type using a powder toner has been widely employed.

The powder toner, however, tends to be scattered and often involves the problem of poor resolution due to its particles having sizes as large as 7~10 $\mu$m.

In applications requiring high resolution, therefore, a wet type electrophotography apparatus using a liquid toner is usually adopted. The liquid toner is less subject to distortion in toner images and can achieve high resolution because it contains toner particles as small as 1 $\mu$m and has a large charging capacity.

In the conventional wet type electrophotography apparatus, a low-viscosity liquid toner obtained by mixing 1~2% of toner in an organic solvent has been commonly used as the developing solution. This type of developing solution, however, causes environmental concerns because it contains an organic solvent harmful to human bodies and requires a large amount of toner consumption due to low concentration.

It was against this background that a wet type electrophotography apparatus using a high-viscosity, high-concentration developing solution obtained by dispersing a high-concentration toner in silicone oil, etc. was disclosed in International Disclosure Number "WO95/08792."

The use of this liquid toner eliminates not only the harm to human bodies but also the need for large consumption of developing solution due to high toner concentration.

As disclosed in "International Disclosure Number WO95/08792," the wet type electrophotography apparatus using high-viscosity, high-concentration liquid toner as the developing solution has employed the same construction as with the dry type apparatus using a powder toner, in which a developing solution is applied to a developing roller or belt, which is brought into contact with a photoconductive medium to cause the toner to deposit on the photoconductive medium on which an electrostatic latent image is formed.

That is, as in the dry type where the powder toner is applied to the developing roller using a purely mechanical contact means, the wet type using a non-volatile, high-viscosity, high-concentration liquid toner also employs a purely mechanical contact means in applying the developing solution to the developing roller. The application of the developing solution is accomplished by finishing the surface which makes mechanical contact with the developing roller to a high-precision finish.

That is, development is carried out by applying a liquid toner onto a developing roller 22, causing the developing roller 22 to face a photoconductive medium 10 and applying a voltage to the developing roller 22, as shown in FIG. 25. At this time, an image area and a non-image area (background area) are formed randomly in accordance with an image pattern on the toner layer on the developing roller 22 after development. Rollers 23~25 in FIG. 25 are a series of applicator rollers for feeding the developing solution to the developing roller 22. These rollers are driven by drive motors 31 and 33, and gears 32 and 34.

If the image area and the non-image area on the developing roller 22 after development, which have different electrical histories on the toner and different amounts of residual toner, are brought as they are to the contact area at which the developing roller 22 makes contact with the final-stage applicator roller 23, the evenness of the toner layer formed on the developing roller 22 becomes a problem. Even if the toner layer is formed evenly, the image pattern at the previous rotation of the developing roller 22 may appear on the image in synchronism with the period of the roller due to the electrical history experienced by the toner. Such a phenomenon is a trouble often referred to as the development memory. It is necessary therefore to have a reset mechanism for erasing the history left as the result of a development operation.

A problem characteristic of the liquid developing process is that when a prewetting solution is used as a release agent to prevent blushing, the prewetting solution deposited on the developing roller 22 causes the dilution of the developing solution. To cope with this problem, a rubber blade 37 has heretofore been used to scrape off the residual toner layer on the developing roller 22.

As a means to solve the trouble called the development memory and the dilution of the developing solution, the use of the rubber blade to scrape off the residual toner layer is effective only when the blade is used to wipe off something on a surface of a relatively hard material, as with the automotive windshield wiper. However, when the rubber blade is used to scrape off the residual toner on a developing roller of a relatively soft developing roller, the contact pressure between both cannot be satisfactorily maintained.

The pressure between the blade and the roller can be considerably increased by forcing the edge of the blade onto the roller in the "doctor" direction ("biting" direction in which the blade faces the roller at an acute angle). However, but when used with a soft roller with a low hardness, the doctor-blade effect is drastically reduced, leading to an increase in the amount of toner left on the roller.

As disclosed in International Disclosure Number "WO95/08792," when a developing device is constructed using a flexible developing belt, adjustment of the developing belt is extremely difficult, requiring much labor and time. Too tight a developing belt would reduce the flexibility, making the belt too rigid. This makes it impossible to realize the double-layer construction of the liquid toner applied to the developing belt and the prewetting solution layer applied to the photoconductive medium. Too loose a developing belt, on the other hand, would cause a gap between the liquid toner on the developing belt and the prewetting solution layer applied to the photoconductive medium, preventing the movement of the toner. In this way, a developing device using a developing belt would make the adjustment of the developing belt difficult and time-consuming.

When a high-viscosity liquid developing agent is used, the following requirements must be satisfied to form a thin film of the developing agent through the use of a contact roller while maintaining the prewetting solution layer undisturbed. First, the total amount of developing and prewetting agents carried along by the rotation of the photoconductive medium and the developing roller must be passed at a pressure below the contact pressure at the contact area between the developing roller and the photoconductive medium. The lower the hardness of the developing roller the more liquid can be passed. However, the higher the dimensional accuracy of the outside diameter and the wobbling accuracy during rotation of the developing roller, the more stably the pressure on the liquid layer is maintained. In terms of machining, the lower the hardness the more difficult becomes the improvement of machining accuracy.

Second, there must be a prewetting oil layer at all times over the entire region between the developing agent and the surface of the photoconductive medium so as to ensure that the high-viscosity developing agent is kept from directly contacting the surface of the photoconductive medium. If the surface of the high-viscosity toner layer is not a uniform plane, having irregularities, projected parts of the toner layer may pierce through the prewetting solution layer, coming in direct contact with the surface of the photoconductive medium, impairing the releasing effects of the prewetting agent. This may lead to blushing (deposition of unnecessary toner) on the non-image area. The uneven layer on the surface of the developing roller appears on the image area, resulting in a poor image.

In the meantime, there also have been some problems with prewetting treatment.

When a non-volatile, high-viscosity, high-concentration liquid toner is used, prewetting treatment is carried out by applying a prewetting agent, such as silicone oil, to the photoconductive medium prior to the application of the liquid toner to prevent the high-viscosity toner from adhering to non-exposed areas on the electrostatic latent image formed on the photoconductive medium. The prewetting solution layer applied during prewetting treatment helps prevent the toner from adhering to the non-exposed area on the photoconductive medium, as shown in FIG. 12. To ensure stable application of an electrical field and prevent the toner from adhering to the surface of the photoconductive medium as a blush, it is very important to apply the prewetting agent evenly onto the photoconductive medium.

Two methods of applying the prewetting solution on the photoconductive medium are heretofore known; one involving the use of a stationery applicator member, such as felting, and the other involving the use of a roller train comprising a plurality of rollers.

The use of a stationery applicator member involves a sponge block of an almost rectangular cross-sectional shape having a capacity to absorb and hold the prewetting solution, as shown in FIG. 36. The prewetting solution is absorbed and held inside sponge cells based on a capillary action or a gravitational effect, and the sponge is brought into contact with the photoconductive medium 10 in an appropriate manner to apply the prewetting agent to the photoconductive medium 10.

Being of a simple construction, this method can be effective in applying an even coating film if an appropriate material is selected and this method is used for the apparatus operated at relatively low speeds.

The use of a roller train, on the other hand, involves applying the prewetting solution to the photoconductive medium 10 by forming a prewetting agent film on rollers, which is in turn caused to make contact with the photoconductive medium and rotate at the same speed as the photoconductive medium, as shown in FIG. 36. The roller train can be some combinations of rollers made of open-cell sponge, or solid rollers, etc.

With this method, the prewetting agent can be applied on the photoconductive medium in a smooth film if the apparatus is operated at low speeds and a low-viscosity prewetting agent is used due to the self-recovery of the prewetting solution resulting from the effects of gravitation and surface tension. When a high-viscosity prewetting solution is fed to the roller train operated at the same speed, however, it is generally known that a remarkably mottled pattern tends to be formed in the neighborhood of the exit.

As a result, even after prewetting treatment, image noise may be produced because the toner is undesirably deposited on the non-exposed area on the electrostatic latent image on the photoconductive medium, on which the toner is not desired to be deposited.

To describe this problem more specifically, now assume a developing device in which a liquid toner is fed from the toner pool while spreading into a thin film using a plurality of interconnecting applicator rollers to form a toner layer on the developing roller, and depositing the toner that is electrostatically charged by an electrical field formed between the developing roller and the photoconductive medium on the exposed area on the photoconductive medium. At the contact portion of the developing roller 22 and the last-stage applicator roller 23, the toner layer receives a compressive force from both rollers, as shown in FIG. 11. As the toner layer approaches the exit of the nip portion, the toner is relieved of the compressive force, and instead receives a tensile force due to the viscosity of the toner itself and its adherence to the roller surface. Thus, the toner layer is separated into two layers on the developing roller 22 and the applicator roller 23, accompanying the toner in the surrounding area. This results in fine streaks (irregularities) left on the developing roller.

As a result, as the developing roller 22 makes contact with the photoconductive medium 10, projected parts of the fine streaks of the toner on the developing roller 22 pierce the prewetting solution layer on the photoconductive medium 10, reaching the surface of the photoconductive medium 10, as shown in FIG. 10. This causes noise in the non-exposed area. This uneven toner layer appears on the exposed area, leading to a poor image.

In this way, the prior art tends to produce image noises because the toner may be deposited on the non-exposed area of the static latent image on the photoconductive medium on which the toner is originally not to be deposited. The prior art also tends to be involved with blushing or blurred edges.

Observation results of dots or fine-line edges on an image formed and developed with a liquid toner with the toner particle content of 20 wt. % and a viscosity of 600 mPa·S revealed that there were blurred edges on the image. This was attributable to that the toner tends to run due to the low cohesive strength of the toner layer on the photoconductive medium 10, and that when the toner layer is dispersed at high concentrations on the developing roller 22, the toner layer at the edge parts are not clearly separated in both the image and non-image areas. When a toner having the toner particle content of 10% and the same thickness is formed on the developing roller 22 and developed, dots or fine-line edges on the image become very sharp due to the good migration properties of the toner, whereas the image density lowers due to the insufficient amount of toner particles. Increasing the thickness of the toner layer by the amount of lowered image density, however, would increase the tendency to disturb the static latent image formed on the photoconductive medium.

As a means for solving this problem, the photoconductive medium can be exposed only after the prewetting solution has been applied, as disclosed in International Disclosure Number "WO95/08792." This method, however, poses another problem of disturbed images due to fluctuations in the thickness of the prewetting solution layer.

Furthermore, although a cam mechanism for causing the porous sponge to make contact with, or detach from, the photoconductive medium is disclosed in International Disclosure Number "WO95/08792," on what occasion the cam mechanism should be operated has not been studied. This may result in an excess amount of prewetting agent applied to the photoconductive medium.

In International Disclosure Number "WO95/08792," moreover, no mechanism is proposed for adjusting the thickness of the prewetting solution layer applied to the photoconductive medium. As a result, the thickness of the prewetting solution layer applied to the photoconductive medium is invariably kept constant, regardless of the types of liquid toners, even when color images are processed.

Either of the methods involving the use of a stationary applicator, made of felting, for example, or the method using a roller train combining a plurality of rollers to apply a prewetting agent to the photoconductive medium, as described above, is less effective in smoothing the surface of the photoconductive medium at higher process speeds. As the viscosity of the prewetting solution increases, this tendency becomes pronounced. Thus, the prewetting solution tends to be fed in mottled patterns to the developing point, producing uneven image density or blushing.

The mottled patterns of the prewetting agent caused by rotating the rollers in the same direction (as viewed in the nip portion) have been examined in several experimental analyses, but have not yet been fully elucidated theoretically. It is generally believed that as the rollers are rotated in the forward direction (one roller is rotated clockwise and the other counterclockwise), the prewetting solution tends to be sheared and separated by both rollers at the exit of the rollers, producing a raindrop-like pattern called "rivulet." The rivulet pattern has an interval of 0.1~1 mm, and the difference between the peak and the bottom is several times as much as the average thickness of the layer. The rivulet is believed to depend on the construction and conditions of the prewetting system, and the viscoelastic properties (rheology) of the prewetting solution.

SUMMARY OF THE INVENTION

This invention has been made taking into account these circumstances. It is therefore an object of this invention to provide a new wet type electrophotography apparatus using a non-volatile, high-viscosity, high-concentration liquid toner that can evenly apply a developing solution to a developing roller.

It is another object of this invention to make it possible to develop a high quality image free of blushing, or blurred edges, by increasing the cohesive strength of the developing toner layer on the photoconductive medium.

It is a further object of this invention to ensure the even color strength of the toner to be applied to the photoconductive drum by sequentially monitoring the thickness of the toner to be fed and controlling the thickness to a predetermined value.

It is still a further object of this invention to make it possible to adjust the color strength of an image by changing the thickness of the toner layer by changing the predetermined value.

It is still a further object of this invention to ensure the stable supply of the liquid toner to the photoconductive medium without destroying the prewetting solution layer applied to the photoconductive medium.

It is still a further object of this invention to solve the problem of the so-called development memory by stably scraping off the residual toner layer on the developing roller for recovery.

It is still a further object of this invention to ensure stable and even application of the prewetting solution over the entire surface of the photoconductive medium in a wet type electrophotography apparatus using a non-volatile, high-viscosity, high-concentration liquid toner.

That is, this invention makes it possible to cause toner particles in the developing solution applied to the surface of the rotating roller (final-stage rotating roller or an electrically conductive roller provided separately) of the developing solution applying means to coagulate by applying a bias voltage to the rotating roller, thereby causing the toner particles to migrate to the developing roller. This invention makes it possible to develop high-quality images free of blushing or blurred edges since the toner is made hard to flow and the toner layer is clearly separated at the edge parts in both the image and non-image areas by increasing the cohesive strength of the developing toner layer.

Furthermore, this invention makes it possible to use a liquid toner of a relatively low toner concentration without causing lowered image density due to the shortage of toner particles by increasing the cohesive strength of the developing toner layer. This makes it possible to adopt a construction in which the thickness of the prewetting solution layer can be reduced or no prewetting agent is used.

This invention adopts a construction where the developing solution applying means comprises a plurality of interconnecting rotating rollers for transporting the developing solution by spreading and applying the solution to the surfaces of the rotating rollers, and causing the final-stage rotating roller coming in contact with the developing roller to rotate in the opposite direction (as viewed in the nip portion) to that of the developing roller, so that the film of the developing solution applied to the surface of the final-stage rotating roller can be applied to the surface of the developing roller coming in contact with the final-stage rotating roller. This makes it possible to evenly apply the developing solution to the developing roller, and eliminate image noises by preventing the toner from being deposited on the non-exposed area of the static latent image on the photoconductive medium in a wet type electrophotography apparatus using a non-volatile, high-viscosity, high-concentration liquid toner.

This invention makes it possible to keep the color strength of the toner to be applied to the photoconductive medium 10 uniform by monitoring the thickness of the developing solution layer on the surface of the final-stage rotating roller, controlling the gap or contact pressure between the rotating rollers of the developing solution applying means so as to maintain the thickness of the developing solution layer at a predetermined value, or by causing the final-stage rotating roller coming in contact with the developing roller to rotate in the direction opposite (as viewed in the nip portion) to that of the developing roller, monitoring the thickness of the developing solution layer applied to the surface of the final-stage rotating roller, and controlling the revolution of the roller located before the final-stage rotating roller so as to maintain the layer thickness at a predetermined value.

Furthermore, this invention can adjust images to the optimum color strength in accordance with the surface roughness and type of the printing medium by changing the predetermined value to change the thickness of the toner layer.

This invention makes it possible to stably supply a liquid toner to the photoconductive medium without destroying the prewetting solution layer on the photoconductive medium, in a wet type electrophotography apparatus using a non-volatile, high-viscosity, high-concentration liquid toner, since the developing solution is supplied to the photoconductive medium because the developing roller has an electrical conductivity for applying an electrical field to the photoconductive medium and an elasticity, and is so constructed that the developing roller, when at a standstill, makes contact with the photoconductive medium, and during rotation, faces the photoconductive medium with a small gap in accordance with the elasticity of the developing roller, the viscosity of the developing solution applied to the surface, and the viscosity of the prewetting solution on the photoconductive medium, and since the developing roller has an electrical conductivity for applying an electrical field to the photoconductive medium, and a rigidity, and a pushing means forces the developing roller onto the photoconductive medium in accordance with the repulsion force received by the developing roller.

This invention makes it possible to apply a prewetting solution to the entire surface of the photoconductive medium, in a wet type electrophotography apparatus using a non-volatile, high-viscosity, high-concentration liquid toner, by providing a prewetting agent applicator roller having high insulating properties which rotates while contacting the photoconductive medium to apply a prewetting agent film on the photoconductive medium, and at least one or more interconnecting rollers which rotate while contacting the prewetting agent applicator roller, adjusting the contact part between the prewetting agent applicator roller and the interconnecting rollers, supplying the prewetting solution to the contact part in an amount sufficient to maintain a pool of the prewetting solution at the contact part, or controlling the amount of prewetting solution fed to the rotating roller.

This invention prevents the thickness of the prewetting solution layer from being fluctuated, and prevents the electrostatic latent image formed on the photoconductive medium from being disturbed. This invention prevents the prewetting solution from being applied excessively onto the photoconductive medium, and prevents the thickness of the prewetting solution layer applied to the photoconductive medium from being unilaterally kept constant, regardless of the type of the liquid toner.

This invention makes it possible to evenly apply the prewetting solution over the entire surface of the photoconductive medium without producing mottled patterns or rivulets by providing in the prewetting device a prewetting agent applicator roller for applying the prewetting solution by rotating while making contact with the photoconductive medium in the opposite direction to the rotation of the photoconductive medium.

This invention makes it possible to solve the problem of developing memory, in a wet type electrophotography apparatus using a non-volatile, high-viscosity, high-concentration liquid toner as a liquid developer, by providing a reverse scraping roller for stably scraping and recovering the residual toner on the developing roller by rotating while making contact with the developing roller after development in the opposite direction to the rotation of the developing roller.

DESCRIPTION OF THE PREFERRED EMBODIMENTS

In the following, this invention will be described in detail in reference to some embodiments. This invention uses as the developing solution a non-volatile, high-viscosity liquid toner, which consists of solid particles, such as pigments, dispersed in a liquid carrier (oil).

Figure 1:
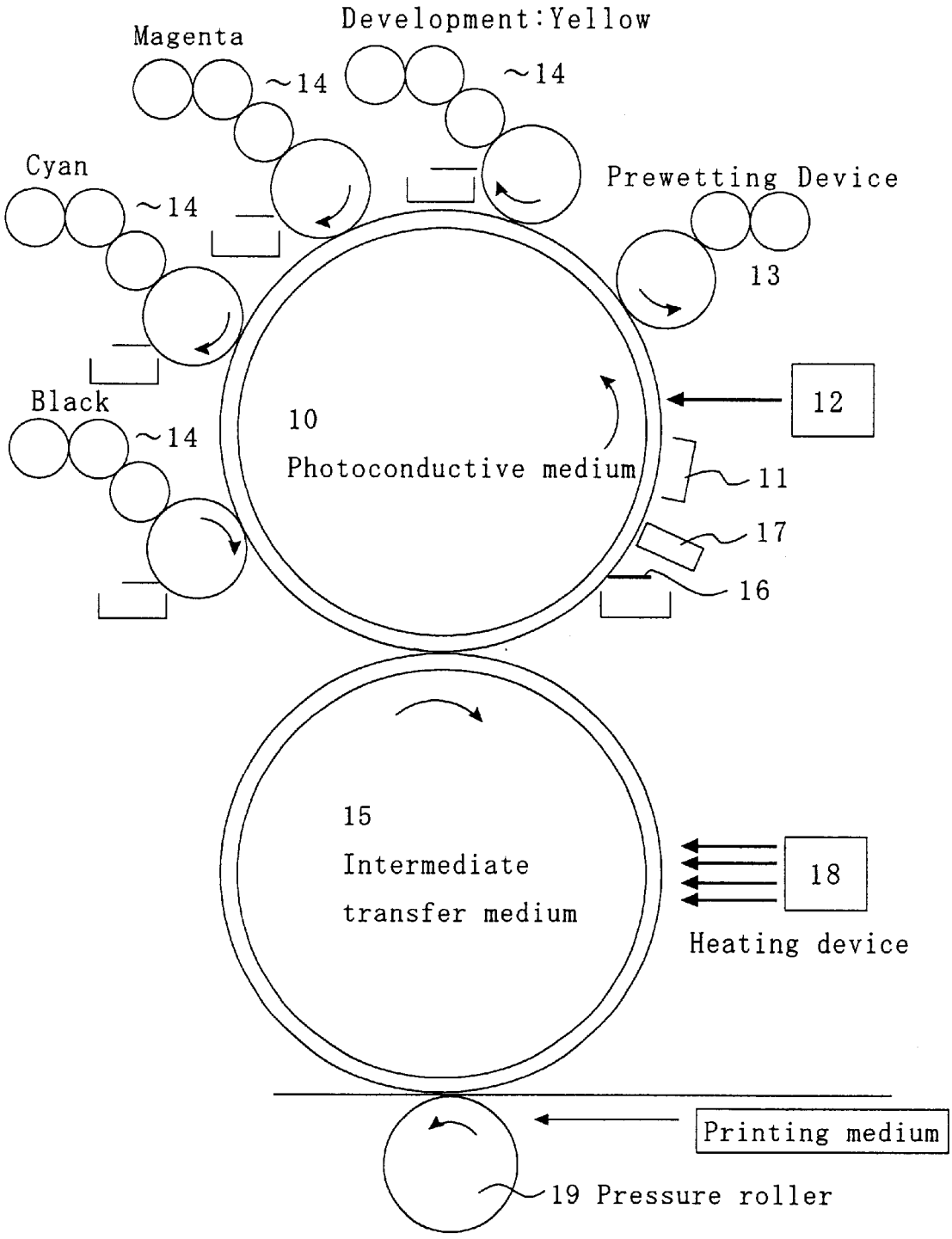
FIG. 1 is a diagram illustrating the overall construction of the wet type electrophotography apparatus according to this invention.

FIG. 1 shows the overall construction of a wet type electrophotography apparatus embodying this invention.

As shown in the figure, the wet type electrophotography apparatus according to this invention comprises a photoconductive medium 10, an electrostatic charging device 11, a light exposure device 12, a prewetting device 13, developing devices 14, an intermediate transfer medium 15, a blade 16, a static charge eliminator 17, a heating device 18, and a pressure roller 19.

The electrostatic charger 11 electrostatically charges the photoconductive medium 10 to approximately 700 V. The light exposure device 12 exposes the photoconductive medium 10 using a laser beam having a wavelength of 780 nm to form on the photoconductive medium 10 a static latent image the potential of whose exposed part is approximately 100 V.

The prewetting device 13 applies silicone oil of a viscosity of about 2.5~20 cSt on the surface of the photoconductive medium 10 to a thickness of 4~10 $\mu$m. The prewetting device 13 may carry out prewetting treatment prior to exposure treatment by the light exposure device 12 in some cases, or after the exposure treatment in other cases.

The developing devices 14 are provided to handle four colors of yellow/magenta/cyan/black. Biased at about 400 V~600 V, the developing device 14 forms a toner layer having a thickness of 2~3 $\mu$m on a developing roller (developing solution carrier) 22 by transporting a liquid toner with a toner viscosity of 400~4000 mPa·S and a carrier viscosity of 20 cSt while thinly spreading it using interconnecting applicator rollers 23~25, as will be described later, referring to FIG. 2. The developing roller 22 deposits the toner on an exposed area of the photoconductive medium 10 that is charged to about 100 V by feeding the toner, which is positively charged by an electrical field formed between the developing roller 22 and the photoconductive medium 10, to the photoconductive medium 10.

Figure 12:
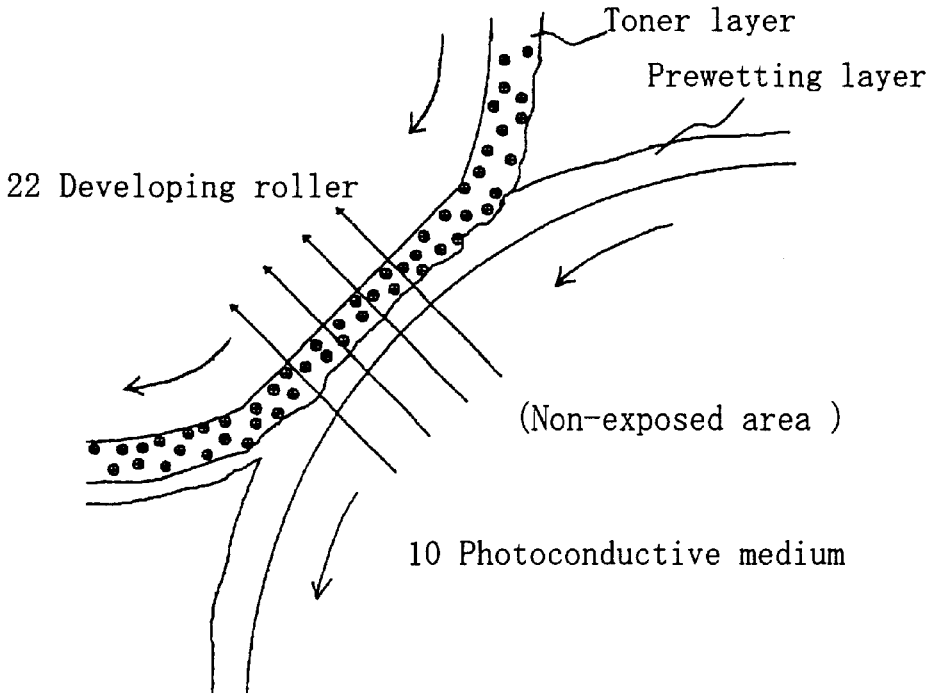
FIG. 12 is a diagram of assistance in explaining the operation of the prewetting solution layer on the surface of the photoconductive medium.

The toner is prevented from adhering to a non-exposed area of the photoconductive medium 10 by a prewetting solution layer applied by the prewetting device 13, as shown in FIG. 12.

The toner deposited on the photoconductive medium 10 is transferred on the intermediate transfer medium 15, which is biased at about −800 V, in accordance with an electrical field formed between the intermediate transfer medium 15 and the photoconductive medium 10. The yellow toner, the magenta toner, the cyan toner, and then the black toner deposited on the photoconductive medium 10 are transferred one after another on the intermediate transfer medium 15.

The blade 16 removes the toner and the prewetting solution remaining on the photoconductive medium 10. The static charge eliminator 17 removes the charge on the photoconductive medium 10.

The heating device 18 fuses the toner deposited on the intermediate transfer medium 15 by heating the surface of the intermediate transfer medium 15. The pressure roller 19 fixes the toner on the intermediate transfer medium 15 that has been fused by the heating device 18. Having the construction where the toner deposited on the intermediate transfer medium 15 is fused and fixed on a printing medium without heating the printing medium, using the heating device 18 and the pressure roller 19, the wet type electrophotography apparatus according to this invention can handle printing media, other than paper.

Figure 2:
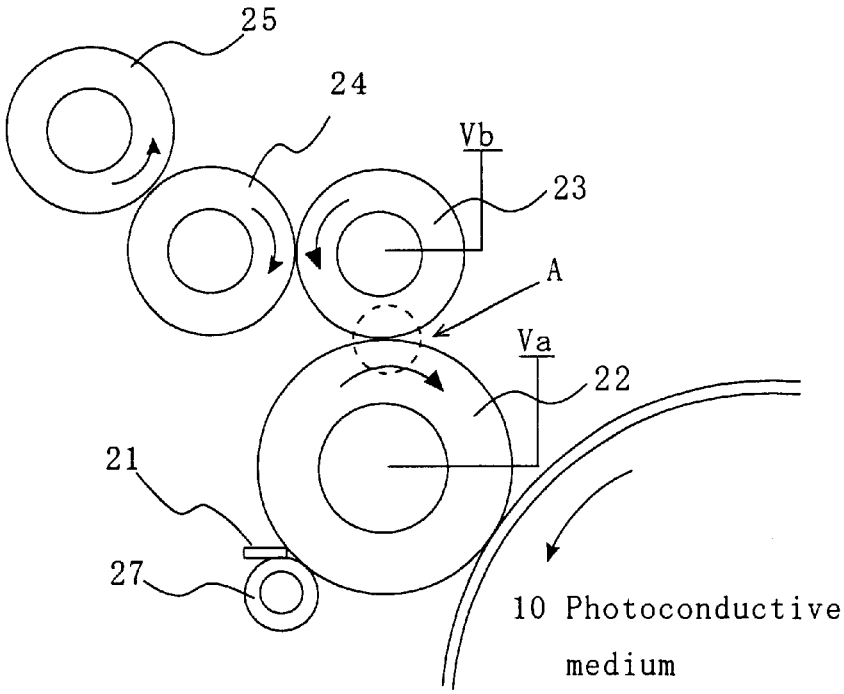
FIG. 2 shows a developing roller coming in contact with the photoconductive medium and a series of applicator rollers for supplying the developing solution.

FIG. 2 shows the developing roller 22 coming in contact with the photoconductive medium (drum) 10, and a series of applicator rollers 23~25 for feeding the developing solution. The applicator rollers comprise a final-stage applicator roller 23 coming in contact with the developing roller 22, and one or more rollers. Although three applicator rollers 23, 24 and 25 are shown in the figure, the applicator rollers are provided in an appropriate number needed to spread the developing solution thinly and uniformly on the developing roller 22. The roller 22 is a developing roller that feeds the developing solution while making contact with the photoconductive medium 10 so that a double-layer construction of the developing solution and prewetting solution films on the photoconductive medium 10, and deposits on the photoconductive medium 10 the toner particles positively charged in accordance with an electrical field formed between the developing roller 22 and the photoconductive medium 10. The roller 23 is a final-stage applicator roller that causes most of the toner particles in the developing solution to migrate to the developing roller 22 by the bias potential between the developing roller 22 and the final-stage applicator roller 23.

The blade 21 can be provided on the developing roller 22 in such a manner that the blade 21 makes contact with the developing roller 22 in a direction counter to the rotating direction of the developing roller 22 after the developing roller passes the developing point, so that the residual toner on the developing roller 22, and the prewetting agent adhering to the developing roller 22 can be completely removed, and the liquid toner can be newly fed to the developing roller 22 in a clean state. A roller 27 can also be provided in conjunction with the blade 21 to scrape the residual toner on the contact portion between the blade 21 and the developing roller 22.

As noted earlier, there are various problems when images are developed in normal practices using a liquid toner without applying a bias voltage to the final-stage applicator roller 23; including the propensity for the toner to run due to low cohesive strength of the developing toner on the photoconductive medium 10, and failure to clearly separate the toner layer at the edge parts of the image and non-image areas in a state where the toner layer of a high concentration is dispersed on the developing roller 22.

This problem can be solved by applying a bias voltage to the final-stage roller 23 coming in contact with the developing roller 22 when forming the toner layer on the developing roller 22 via the applicator rollers 23~25. This applicator bias voltage Vb is set at a level 150~300 V higher than the developing roller bias Va. This permits the positively charged toner particles to migrate from the final-stage applicator roller 23 to the developing roller 22 to form a uniform toner layer on the developing roller 22.

Figure 3:
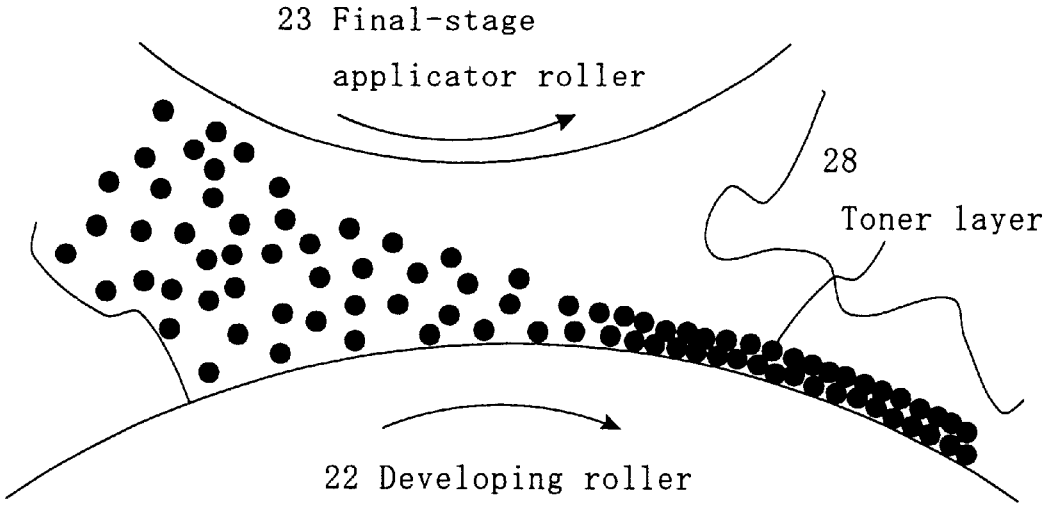
FIG. 3 is a diagram of assistance in explaining the operation of causing toner particles in the developing solution to move to the developing roller by means of a potential difference.

FIG. 3 is a diagram of assistance in explaining how the developing solution toner particles are moved to the developing roller by a potential difference, showing the details of part A encircled by a dotted line in FIG. 2. It is possible to increase the holding power and adsorbing power of the toner particles (solid particles) to the developing roller by applying a bias voltage (Vb−Va) across the developing roller 22 and the final-stage applicator roller 23 to impart the force of electrical field to the nip portion between both rollers. This helps allows the toner at the edge parts of the image and non-image areas to be separated clearly, improving the sharpness of the edge parts. By positively moving the toner particles between the final-stage applicator roller 23 and the developing roller 22 by means of the bias force, the amount of toner particles is increased on the developing roller, with the result that a sufficient image density can be obtained even when a toner of a 10-wt. % concentration is used. Observation of the state of toner on the developing roller 22 and the final-stage applicator roller 23 revealed that almost all toner particles migrated to the developing roller 22 to such an extent that the content of toner on the developing roller 22 was twice as much as the initial toner content. It was also observed that only the carrier oil content was present on the final-stage applicator roller 23 after both rollers made contact with each other, with the densely formed toner layer 28 covered with the carrier oil on the developing roller 22. As a result, the actual thickness of the toner layer was equal to, or thinner than, the initial toner layer. Furthermore, blushing margin was also improved since the carrier oil covering the toner layer 28 serves as a prewetting agent. This would increase the hardness of the developing roller 22, leading to improved wobbling accuracy of the roller. In addition, this would lead to a reduction in thickness of the prewetting solution layer, reducing the consumption of the prewetting agent. When a liquid toner having the toner content of less than 10 wt. % is used, the thickness of the carrier oil layer covering the toner layer also increases considerably, making it possible to do without the prewetting agent.

Application of this bias potential can be accomplished by using a roller whose surface is made of an electrically conductive material as the final-stage applicator roller 23. The resistance value of the developing roller should be less than $10^6$ Ω, or more preferably less than $10^4$ Ω from the viewpoint of image density. Measurement results obtained by changing the resistance value of the applicator roller revealed that when the current flowing between the developing roller and the applicator roller is of the order of several tens of μA, the toner did not migrate sufficiently to the developing roller. At higher than 100 μA of current, however, the toner migrated sufficiently to form the desired toner layer. Taking this observation into account, the resistance value of the applicator roller should be less than $10^5$~$10^7$ Ω. Should the resistance of the developing roller be higher than that of the applicator roller, developing bias could be increased by the applicator bias, causing blushing. The resistance value of the developing roller should therefore be sufficiently lower.

The thickness of the toner layer on the developing roller is maintained at about 5~10 μm at a toner concentration of 20 wt. % to maintain image density at a satisfactory level. For this reason, a roller having a surface roughness of more than Rz=10 μm (urethane roller with a hardness of JIS-A 30 degrees and a resistance value of about $10^{-6}$ Ω) was used as the final-stage applicator roller 23. When an applicator bias was applied to the roller, a mottled pattern replicating the surface roughness of the roller was produced on the toner layer on the developing roller. When a roller with a relatively smooth surface (urethane roller with a hardness of JIS-A 90 degress) was used as the final-stage roller, this mottled pattern disappeared.

In the following, the results of verification by applying an electric field are shown. Table 1 shows the study results of the uniformity of the toner layer on the developing roller 22. With the amount of toner set at about 1 μm for three developing agents having different apparent viscosity, the variability (irregularities) of the toner layer thickness on the developing roller 22 was measured by changing the voltage (Vb−Va) between the final-stage applicator roller 23 and the developing roller 22. The table indicates that although the variability of the toner layer thickness is dependent upon apparent viscosity (type of developing agent), the variability decreases with increases in the voltage (Vb−Va) with any developing agents of different viscosity values. The apparent viscosity is determined by the concentration and particle size of toner particles, the properties of pigments, the viscosity of carrier oil, etc.

Table 2 below shows the results of similar verification through application of electrical fields to determine the quality (blushing: deposition of unwanted toner). The state of image quality (blushing) was measured for three types of developing agents, as in Test 1, by changing the voltage (Vb−Va) between the final-stage applicator roller 23 and the developing roller 22. The table indicates that although image quality depends on apparent viscosity, it improves with increases in the voltage (Vb−Va) for any developing agents of different viscosity values.

Table 3 below shows the results of similar verification through application of electrical fields to determine the uniformity of the toner layer, as in Test 1. The variability (irregularity) of the thickness of the toner layer on the developing roller was measured for average amounts (1 μm, 2 μm, 3 μm) of toner in a developing agent by changing the voltage (Vb−Va) between the applicator roller and the developing roller. The table reveals that although the variability of the toner layer thickness depends on the amount (average layer thickness) of developing agent, it decreases with increases in the voltage (Vb−Va).

TABLE 1

Test 1: Uniformity of toner layer on developing roller

| | (Vb−Va) voltage | | | | |
|---|---|---|---|---|---|
| | 0 V | 100 V | 200 V | 300 V | 500 V |
| Developing agent 1 | X | ○ | ○ | ○ | ○ |
| Developing agent 2 | X | Δ | ○ | ○ | ○ |
| Developing agent 3 | X | X | X | Δ | ○ |

Developing agent 1:400 mPa · S Developing agent 2:500 mPa · S

Developing agent 3: 2000 mPa·S

O: The peak value on the developing roller is less than 3 μm.

Δ: Less than 5 μm. X: 5 μm or more.

TABLE 2

Test 2: Quality of developed image (blushing)

| | (Vb−Va) voltage | | | | |
|---|---|---|---|---|---|
| | 0 V | 100 V | 200 V | 300 V | 500 V |
| Developing agent 1 | X | Δ | ○ | ○ | ○ |
| Developing agent 2 | X | X | Δ | ○ | ○ |
| Developing agent 3 | X | X | X | X | Δ |

Developing agent: The same as with Test 1.

O: Image quality if good. Δ: Slight blushing observed.

X: Serious blushing observed.

[Table 3]

TABLE 3

Test 3: Amount (average layer thick.) of developing agent and uniformity

| | (Vb−Va) voltage | | | | |
|---|---|---|---|---|---|
| | 0 V | 100 V | 200 V | 300 V | 500 V |
| 1 μm | X | ○ | ○ | ○ | ○ |
| 2 μm | X | X | Δ | ○ | ○ |
| 3 μm | X | X | X | Δ | ○ |

○: The peak value on the developing roller is less than 3 μm.
Δ: Less than 5 μm. X: 5 μm or more.

As described above, the uniformity of the toner layer, or image quality was found to be improved with increases in voltage. It should be noted, however, this voltage ceiling value is set, judging from the entire arrangement, so as to prevent the toner from being excessively stressed to cause the dispersed toner to heavily agglomerate to such an extent to preclude recycling. That is, both the electrical field between the developing roller 22 and the final-stage applicator roller 23, and the electrical field between the developing solution transport rollers, which will be described later, are set at a value smaller than the electrical field formed between the photoconductive medium 10 and the developing roller 22, or the time for the toner to pass between both the fields is set shorter by changing the length of the nip portion, for example. By constructing in this way, the dispersed toner can be prevented from being agglomerated heavily to an unrecyclable state.

Figure 4:
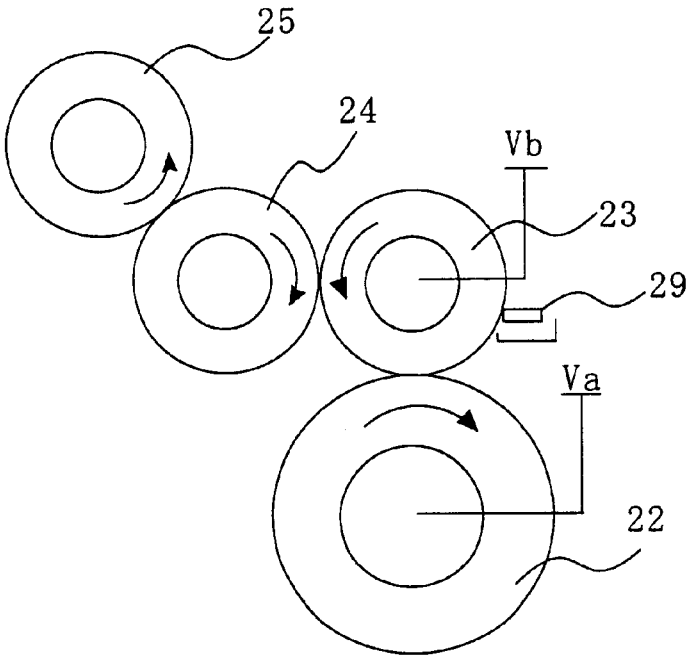
FIG. 4 is a blade for removing the residual carrier oil on the final-stage applicator roller.

FIG. 4 shows the blade 29 coming in contact with the final-stage applicator roller 23. When development is carried out by applying a bias voltage Vb to the final-stage applicator roller 23, almost all the toner particles migrate to the roller 22, as described above, but part of the carrier oil remains on the final-stage applicator roller 23, building up on the nip portion between the final-stage applicator roller 23 and a second applicator roller 24, and mixing with the toner transported from a roller 25. This would reduce the concentration of the toner and disturb the formed toner layer. To cope with this, a blade 29 is provided on the final-stage applicator roller 23 to remove the residual carrier oil.

Figure 5:
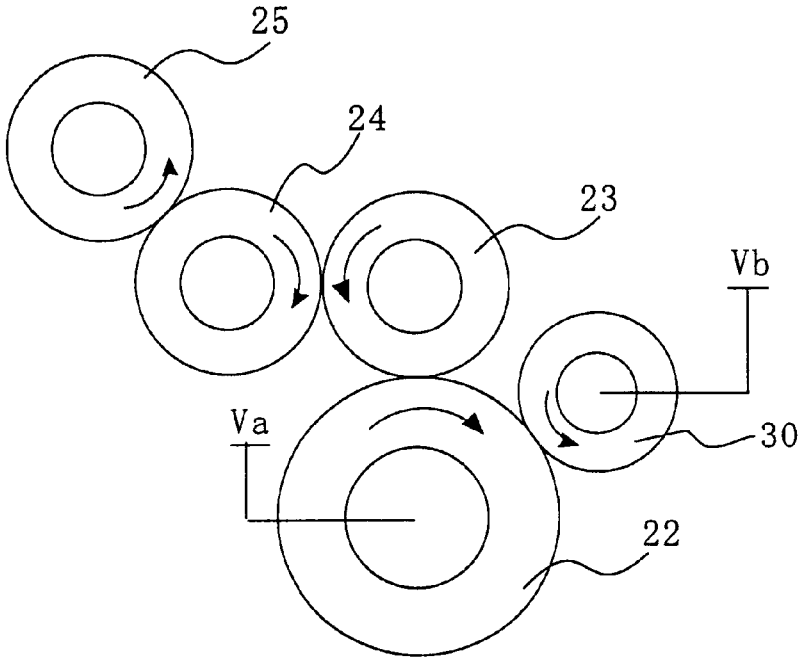
FIG. 5 shows another example of bias voltage application.

FIG. 5 shows another example of bias-voltage application. That the developing solution of a reduced toner concentration remains on the final-stage applicator roller 23, as described above, is attributable to that the toner transport roller also serves as the bias application roller. The effects of the carrier oil remaining on the final-stage applicator roller 23 can therefore be eliminated by separately providing a roller 30 for applying an applicator bias Vb, independently of the toner transport roller.

Furthermore, an electrically conductive blade (not shown) can be provided on the developing roller 22, in addition to the final-stage applicator roller, for example, to apply a voltage to form an electrical field, thereby imparting a toner attracting force to the developing roller 22 to ensure an even toner layer.

Figure 6:
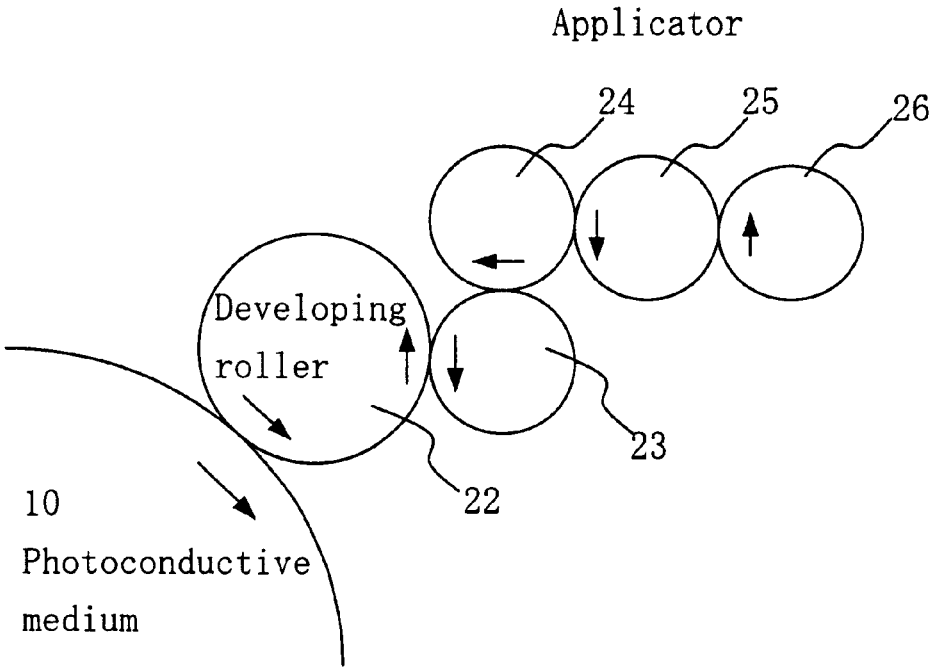
FIG. 6 is a diagram of assistance in explaining the operation of the developing roller coming in contact with the photoconductive medium and a series of applicator rollers.

FIG. 6 shows the developing roller 22 coming in contact with the photoconductive medium 10, and a series of applicator rollers 23~26 for feeding the developing solution to the developing roller 22. In the example shown in the figure, the final-stage applicator roller 23 is caused to rotate in the opposite direction to the developing roller 22. This means that both rollers at the contact portion move in opposite directions to each other.

Generally speaking, when the developing solution is applied to the developing roller via the applicator roller to form a thin layer, fine streaks of the developing solution may be caused, due to changes the balance among the viscosity, feed rate of the developing solution, roller rotation, etc. These fine streaks can be reduced by causing the contact portion of the final-stage applicator roller 23 to move in the opposite direction to that of the developing roller 22, as described above.

Figure 7:
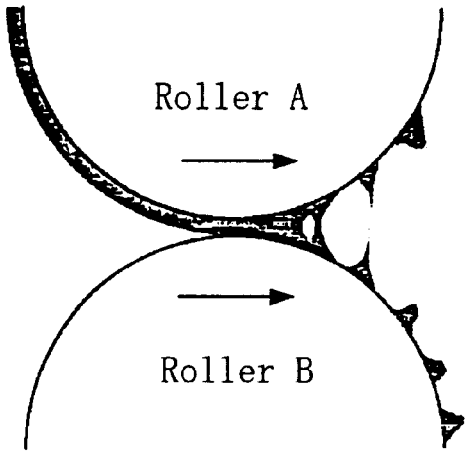
FIG. 7 is a diagram of assistance in explaining the state of a liquid toner between two rollers rotating in the same direction.

In the following, the reason why fine streaks of the developing solution can be reduced by causing the contact portion of the final-stage applicator roller 23 to move in the opposite direction to that of the developing roller 22 will be described. First, the state of the contact portions of the rollers A and B moving in the same direction, not in the opposite direction, and are going to separate from each other after they make contact with each other is shown in FIG. 7. As both rollers separate from each other at the contact portion as the result of rotation of both rollers, the balance between the viscosity of the liquid toner itself and the adhering force thereof to both rollers is disrupted, and the liquid toner is ruptured and separated into two layers at the center. At this time, the carrier oil that tends to concentrate on the separating portion entrains the surrounding liquid toner. This results in local concentrations of the liquid toner, causing streaks in the rotating direction on the developing roller, with almost no liquid toner left in between the streaks.

Figure 9:
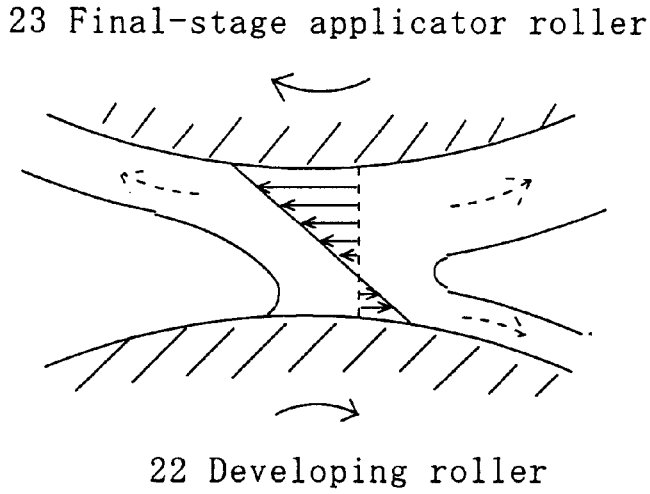
FIG. 9 is a diagram of assistance in explaining the reason why the toner layer can be made uniform by rotating the reverse homogenizing roller while making contact with the developing roller in the opposite direction.

These fine streaks can be prevented by causing the contact portions of the final-stage applicator rollers 23 and the developing roller 22 to move in the opposite direction to each other. FIG. 9 is a diagram of assistance in explaining the profile of toner speed between the two rollers that rotate in the same direction, with the contact portions thereof moving in the opposite direction. The liquid toner on the nip portions of both rollers is entrained by each roller, moving in the opposite direction in different degrees in accordance with its location. The lengths and directions of arrows shown in the figure represent the moving speeds and directions of the liquid toner at the respective locations. The point of zero speed exists in the inner layer between both rollers, at which the liquid toner is sheared, deformed and separated.

To enhance the effects of the counteraction of the roller nip portions, the difference in the rotation of both rollers should preferably be at least more than three times. The amount of toner can be adjusted to a level sufficient to obtain image density on the developing roller 22, or preferably to 5~10 μm, by controlling the difference in the rotation of both rollers, or more specifically the peripheral speed of the final-stage applicator roller 23 via independent motors, reduction gears, etc. Thus, the feed of toner can be adjusted in accordance with the types of liquid toners (yellow/magenta/cyan/black) by controlling the difference in roller rotation.

In FIG. 9 where the contact portions of both rollers move in the opposite direction to each other, the shearing, deforming and separating force causes the toner viscosity to reduce and the toner fluidity to improve, thereby reducing fine streaks, whereas the liquid toner is ruptured and separated in FIG. 7 where the contact portions of both rollers move in the same direction.

Figure 8:
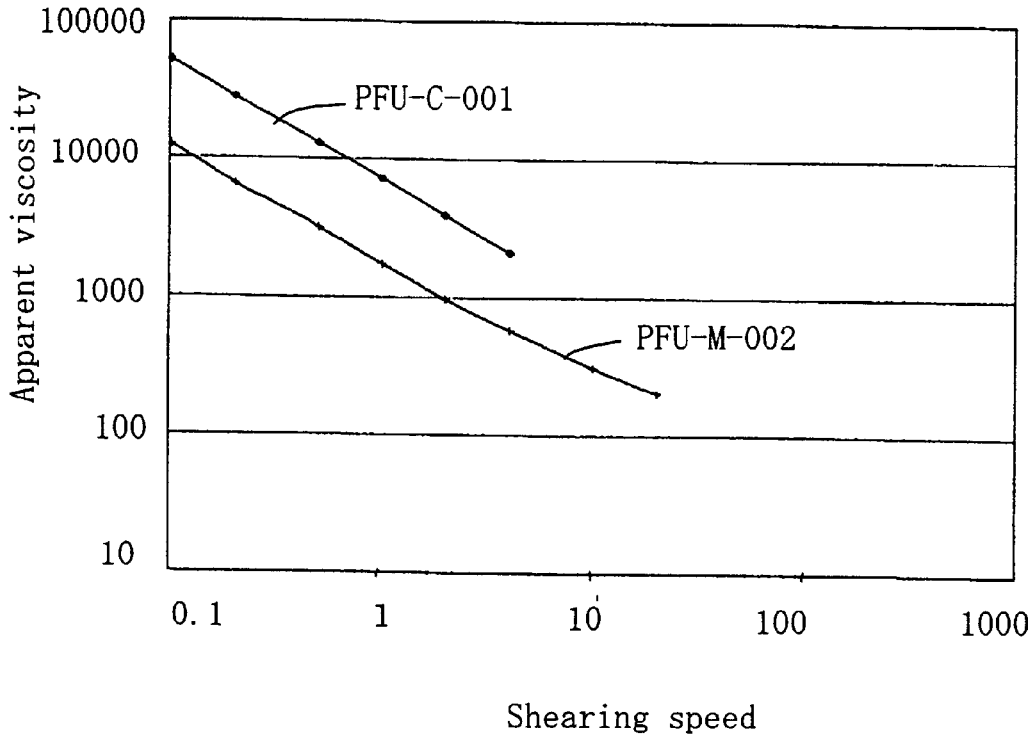
FIG. 8 is a diagram showing measurement results of the relationship between slip speed and the apparent viscosity of the toner.

FIG. 8 shows the relationship between shearing speed and toner apparent viscosity, as measured using a cyan toner (PFU-C-001) and a magenta toner (PFU-M-002), both obtained by dispersing 20 wt. % of toner particles having average particle sizes of 0.6 to 0.7 μm comprising resins and pigments in SH-200-20 cSt silicone oil manufactured by Toray-Dow Corning as the carrier solution. As is evident from the figure, the toner viscosity sharply falls by imparting shearing speed (shearing force). To ensure an even liquid toner layer by causing the contact portions of both rollers to move in the opposite direction to each other, it is essential to maintain a fine roller gap that is about the same as the thickness of the aimed liquid toner layer, or 5~20 μm, for example. It is difficult, however, to guarantee this fine gap in terms of mechanical dimensional accuracy. This can be accomplished by using soft rollers and selecting appropriate values for roller pressure, roller material (surface properties), roller elasticity (hardness), and roller speed to obtain a dynamic gap formed by soft rollers and a viscous fluid.

To achieve this, a high-viscosity toner having a viscosity in the high shear region of 5~1000 mPa·S is used, and the pressure between roller is reduced so that a dynamic gap is produced by the toner between the developing roller and the final-stage applicator roller. To this end, at least one roller whose contact portion is caused to move in the opposite direction to the contact portion of the other roller is made of a roller having a hardness of less than JIS-A 60 degrees.

By using such a high-viscosity toner and causing the contact portion of the applicator roller to move in the opposite direction to the developing roller, a zero point appears in the speed profile between the rollers, causing shear, deformation and separation, instead of rupture and separation. The amount of toner on the side of the developing roller from the zero point can be adjusted to a predetermined amount required for development (1~20 μm) by selecting the pressure, material and elasticity, etc. of the roller.

When an elastic roller having a relatively low hardness and a coarser surface roughness is used as the applicator roller, the force for holding the toner on the surface of the roller increases, causing the zero point of the speed profile to move toward the side of the developing roller. This increases the blade-like action produced by the zero point on the surface of the fluid, leading to an even layer on the developing roller. A tube roller comprising a sponge roller covered with a film, for example, can be used as an elastic applicator roller as mentioned above.

An elastic roller made of a tube roller covered with a film, for example, more preferably having a rubber hardness of less than JIS-A 60 degrees, can be used as the developing roller. Furthermore, belts can be used instead of rollers to construct a developing device.

When an elastic roller is used as the applicator roller, the force for holding the toner on the roller surface increases, causing the zero point in the speed profile to move toward the developing roller side, as described above, if a harder roller whose surface has a relatively low affinity to the toner is used as the applicator roller, a state where the roller surface slips on the toner is caused. If a smooth metallic roller having a relatively high hardness of less than Rz4 is used, for example, the smoothness of the roller surface is considered to be transferred onto the developing roller. As a result, the evenness of the toner layer on the developing roller is improved.

As noted earlier, referring to FIG. 2, the final-stage applicator roller can supply a bias voltage. A uniform toner layer can be formed on the developing roller by providing a rigid leveling roller in contact with the developing roller, in addition to the applicator roller, and causing the leveling roller to rotate in the reverse direction, as shown in the construction of FIG. 5.

Next, measurement results showing the effects of the reverse leveling roller will be described. The rollers used in measurements were disposed as shown in FIG. 6, with only two applicator rollers used, the details of which are as follows:

Developing roller 22: A tube roller having a soft and solid surface made of foamed urethane base (hardness: Aska F68 degrees) Ø32+electrically conductive PFA (50 μm) Speed of developing roller: 250 mm/s (kept constant throughout all measurements)

Applicator roller 23: A hard roller having good surface evenness made of an ebonite roller hardness: more than JIS-A 95 degrees)

Applicator roller 24: A relatively soft roller made of Beet roller (brand name, made of vinyl chloride resin, hardness: JIS-A 20 degrees)

Toner: PFU-C-001

| | |
|---|---|
| Viscosity in high-speed region | 50 mPa · S |
| Viscosity in low-speed region | 2000 mPa · S |

The surface of the developing roller 22 was observed by setting the pressing of the final-stage applicator roller 23 and the developing roller 22 to 0.25 mm, rotating the two applicator rollers 23 and 24 at the same speed, and changing the speed of these applicator rollers 23 and 24 with respect to the developing roller 22.

Measurement 1: The contact portions of the final-stage applicator roller 23 and the applicator roller 24 were rotated at the same speed (250 mm/s) in the same forward direction. The toner was deposited on the developing roller 22 in a mottled pattern and more conspicuously than any other measurements 2~4 below. Rivulets were 0.2 mm in pitch and 10 μm in height.

Measurement 2: The contact portions of the final-stage applicator roller 23 and the applicator roller 24 were rotated at the same speed (250 mm/s) as that in Measurement 1 with respect to the developing roller 22 in the reverse direction. The pattern of continued streaks was observed though it was finer than that obtained in Measurement 1.

Measurement 3: The contact portions of the final-stage applicator roller 23 and the applicator roller 24 were rotated at a speed twice as fast as the speed in Measurement 1 (500 mm/s) in the reverse direction. Several small fragmental mottled patterns were observed.

Measurement 4: The contact portions of the final-stage applicator roller 23 and the applicator roller 24 were rotated at a speed three times as fast as the measurement 1 speed (720 mm/s) in the reverse direction. No visible mottled pattern was observed. The thickness of the toner layer was 4 $\mu$m, the pitch and height of rivulets were 0.2 mm and 3 $\mu$m, respectively. The measurement results revealed that the height of rivulets was substantially reduced, compared with Measurement 1.

As indicated in the above measurement results, the effect of the reverse rotation of the contact portion can be obtained by rotating the roller contact portions at least at a speed twice, or more preferably three times as fast as the speed in Measurement 1.

Figure 13:
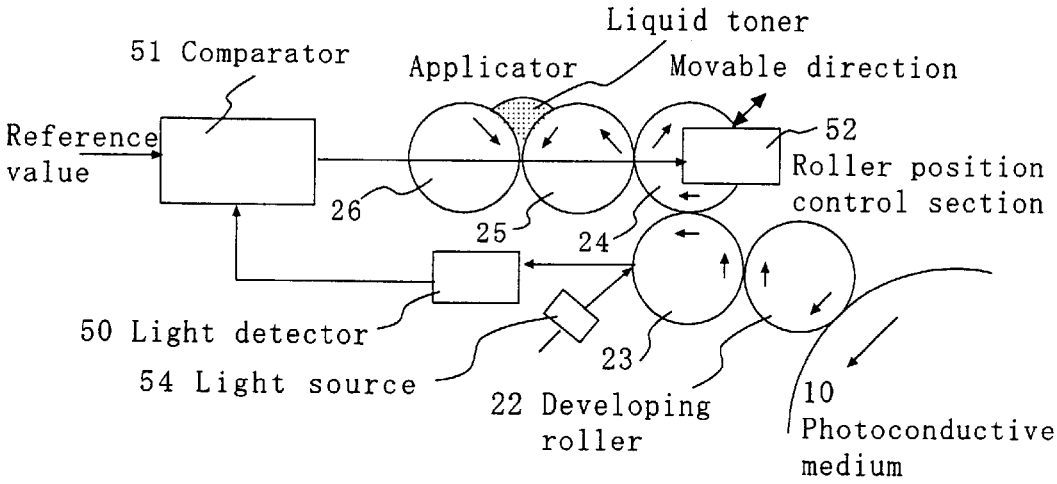
FIG. 13 shows a first example of controlling the thickness of the toner layer on the developing roller to a predetermined value.

FIG. 13 shows a first example in which the thickness of the toner layer on the developing roller 22 is controlled to a predetermined value according to this invention. The figure illustrates a construction of the developing roller 22 coming in contact with the photoconductive medium 10 and a series of the applicator rollers 23~26 for feeding the developing solution to the developing roller 22.

In the example shown in the figure, the final-stage applicator roller 23 has a light reflective surface. The roller having a light reflective surface can be a metallic roller, made of aluminum, stainless steel, etc., or a hard resin roller on the surface of which a light reflective coating is provided by plating a light reflective metal, such as aluminum, stainless steel, etc.

The thickness of the toner layer formed on such a light reflective roller can be detected as the color strength of the toner in a toner color strength detection section comprising a light source 54 and a light detection section 50. That is, changes in the thickness of the toner layer that is normally controlled to less than 10 microns are reduced to changes in the color strength of the toner, which can be detected as the strength of the reflected light obtained as the light from the light source 54 passes through the toner layer on the roller 23 and is reflected by the light-reflective surface of the roller 23. The colors of the toner used here mean yellow, magenta, cyan and black.

A white candescent bulb or LED is used as the light source 54, and a light detection element, such as CCD and photodiode, is used as the light detecting section 50. Detection sensitivity can be improved by using a color filter in accordance with the color of the toner on any one or both of the light source 54 and the light detection section 50.

The detection signal detected by the light detection section 50 is compared with a predetermined reference value in a comparator 51. A roller position control section 52 is controlled in accordance with the comparison results to cause the roller shaft of the applicator roller 24 to move slightly in a direction shown as the movable direction in the figure. This causes the gap between the applicator roller 24, and the applicator roller 25 and the final-stage applicator roller 23 having a light reflective surface (where both rollers are separated and the amount of toner passing through the gap is relatively large), or the contact pressure between both rollers (where both rollers are brought in contact and the amount of toner passing through the gap is relatively small) to change, so that the thickness of the toner layer on the final-stage applicator roller 23 is controlled to a predetermined value, and eventually the amount of toner fed to the developing roller 22 is controlled to a desired value. That is, when the color strength of the toner is low, an instruction is given to the roller position control section 52 to reduce the contact pressure between the applicator rollers, or increase the gap between them, whereas an instruction is given to the roller position control section 52 to carry out the reverse operations when the color strength of the toner is high. The roller position control section 52 can be formed by a ceramic piezoelectric element provided on the roller bearing. The piezoelectric element is an element that is expanded or contracted by a displacement of 20~30 $\mu$m upon application of a voltage. Capable of withstanding a strong pressure, it is suitable for fine positioning.

In the example shown in the figure, the gap or contact pressure between the rollers is controlled by controlling the shaft position of a roller located immediately before the final-stage applicator roller 23, that is, the applicator roller 24 relative to both the applicator roller 25 and the final-stage applicator roller 23. The gap or contact pressure, however, can be controlled by controlling the shaft position of the applicator roller 24 relative to either of the roller 25 or 23.

With such a construction, the gap or contact pressure between the applicator rollers 25 and 26, or the rotation thereof, is controlled so that the liquid toner is fed between the applicator rollers 25 and 26 to form a toner pool. The liquid toner, controlled to a uniform thickness, is supplied onto the developing roller 22 from this toner pool via the applicator rollers 25, 24 and 23.

Arrangements for the detection of the toner layer thickness based on the color strength of the toner and the control of the gap or contact pressure between the rollers based thereon are provided at two locations, right and left, in the longitudinal direction of the rollers, and are individually controlled based on a single reference value to automatically adjust for errors of right and left roller diameters, so that the toner layer thicknesses on right and left sides become equal.

Furthermore, the thickness of the toner layer on the final-stage roller can be controlled by applying an electrical field between the first-stage applicator roller 26 and the second-stage roller 25 and controlling the strength and direction of the field to adjust the amount of toner deposition on the surfaces of the rollers 26 and 25.

Figure 14:
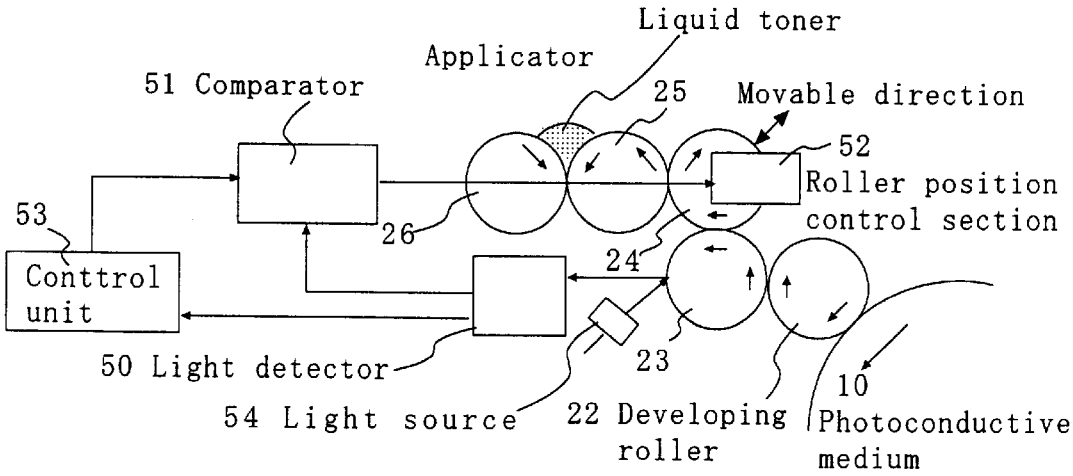
FIG. 14 shows a second example of controlling the thickness of the toner layer on the developing roller to a predetermined value.

FIG. 14 illustrates a second example of a means for controlling the toner layer thickness on the developing roller to a predetermined value according to this invention. In the figure, like numerals denote like elements shown in FIG. 13. The second example shown in FIG. 14 is different from the first example in FIG. 13 in that a control unit 53 is provided.

In the second example, the detection signal detected by the photo detection section 50 is compared with a predetermined value in the comparator 51, and the roller position control section 52 is controlled based on the comparison results to change the gap or contact pressure between the applicator roller 24, and the applicator roller 25 and the final-stage applicator roller having a light reflective surface, thereby controlling the thickness of the toner layer on the final-stage applicator roller 23 to a predetermined value, and eventually the amount of toner fed to the developing roller 22 to a desired value, as in the first example. In addition, the detection signal detected in the light detection section 50 is also fed to the control unit 53 in the second example. The control unit 53 comprising an MPU unit, for example, causes the value entered in the comparator 51 to change in accordance with the signal of the color strength of the toner, the surface irregularities of a printing medium detected by a separate sensor or set manually, and the type of the printing medium (paper or film, for example). With this arrangement, hunting, for example, can be prevented and film thickness can be controlled with high precision by intentionally changing the color strength of the toner, or changing the time required from the detection of the toner layer thickness to the movement of the roller shaft by changing the time constant of the control system to any desired value.

Figure 15:
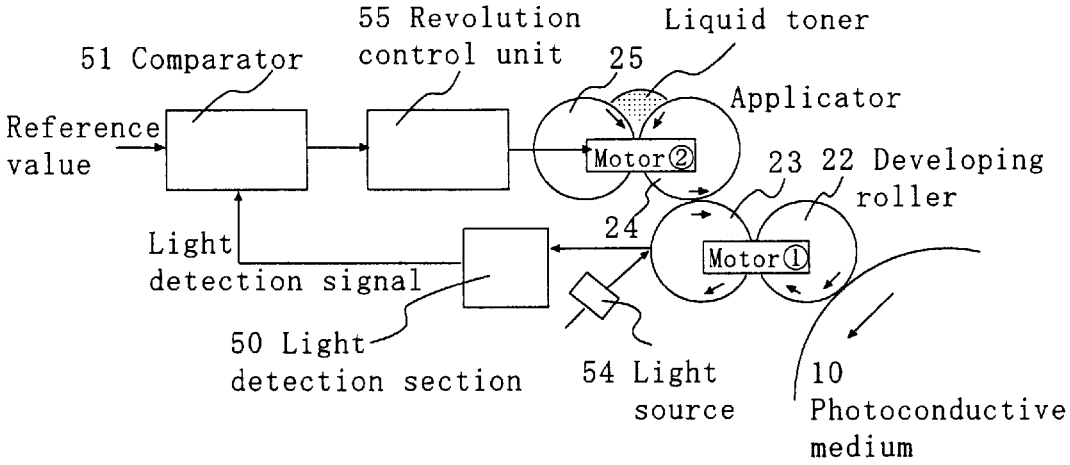
FIG. 15 shows a third example of controlling the thickness of the toner layer on the developing roller to a predetermined value.

FIG. 15 illustrates a third example of a means for controlling the thickness of the toner layer on the developing roller 22 to a predetermined value according to this invention. In the figure, like numerals in FIGS. 13 or 14 denote like elements throughout. A major difference in the third example from the first and second examples shown in FIGS. 13 and 14 is that the rotation of the applicator rollers 24 and 25 is controlled in accordance with the detected toner color strength.

The third example is the same as the previous examples in that the rollers comprise a developing roller 22 coming in contact with the photoconductive medium 10, and a series of applicator rollers for feeding the developing solution, but the applicator rollers in the third example comprise a final-stage applicator roller 23 coming in contact with the developing roller 22, and rollers 24 and 25.

The applicator rollers 24 and 25 are rotated at the same peripheral speed by a motor ② via gears. The developing roller 22 rotates in the normal direction (the contact portions of the developing roller 22 and the final-stage applicator roller 23 move in the same direction) and at the same peripheral speed as the photoconductive medium 10 rotating at a low speed. The reason why fine streaks can be reduced by causing the contact portion of the final-stage applicator roller 23 to move in the opposite direction to that of the developing roller 22 has been described earlier, referring to the construction shown in FIG. 6.

The final-stage applicator roller 23 and the developing roller 22 are rotated by a motor ① via gears. The final-stage applicator roller 23 is normally rotated at higher revolution that the applicator rollers 24 and 25. This is because all the toner on the applicator roller 24 must be transported to the next-stage roller 23 without building up on the roller 24.

The final-stage applicator roller 23 is adapted to have a light-reflective surface. As in the previous examples, the roller having a light-reflective surface can be made of a metal, such as aluminum, stainless steel, etc., or a hard resin roller whose surface has been treated with a light-reflective finish by plating metal, such as aluminum, stainless steel.

The thickness of the toner layer formed on such a light reflective roller can be detected as the color strength of the toner in a toner color strength detection section comprising a light source 54 and a light detection section 50. A white candescent bulb or LED is used as the light source 54, and a light detection element, such as CCD and photodiode, is used as the light detection section 50. Detection sensitivity can be improved by using a color filter in accordance with the color of the toner on any one or both of the light source 54 and the light detection section 50.

The detection signal detected by the light detection section 50 is compared with a predetermined reference value in a comparator 51. A motor ② is controlled via a revolution control section 55 in accordance with the comparison results to cause the revolution of the applicator rollers 24 and 25, so that the thickness of the toner layer on the final-stage applicator roller 23 is controlled to a predetermined value, and eventually the amount of toner fed to the developing roller 22 is controlled to a desired value. That is, when the color strength of the toner is low, an instruction is given to the revolution control section 55 to increase the revolution of the motor ② to increase the revolution of the applicator rollers 24 and 25 to increase the feed of the toner, whereas an instruction is given to the revolution control section 55 to carry out the reverse operations when the color strength of the toner is high.

With such a construction, the gap or contact pressure between the applicator rollers 24 and 25 is controlled so that the liquid toner is fed between the applicator rollers 24 and 25 to form a toner pool. The liquid toner, controlled to a uniform thickness, is supplied onto the developing roller 22 from this toner pool via the applicator rollers 24 and 23.

Figure 16:
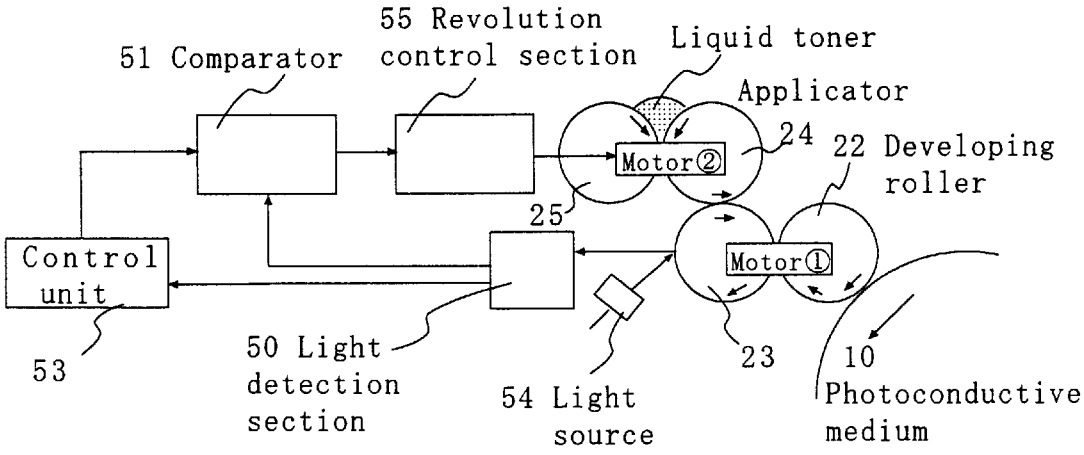
FIG. 16 shows a fourth example of controlling the thickness of the toner layer on the developing roller to a predetermined value.

FIG. 16 shows a fourth example where the thickness of the toner layer on the developing roller is controlled to a predetermined value according to this invention. In the figure, like numerals denote like elements used in FIGS. 13~15. The fourth example is different from the third example shown in FIG. 15 in that a control unit 53 is provided.

In the fourth example, the detection signal detected by the light detection section 50 is compared with a predetermined reference value in a comparator 51. A motor ② is controlled via a revolution control section 55 in accordance with the comparison results to cause the revolution of the applicator rollers 24 and 25, so that the thickness of the toner layer on the final-stage applicator roller 23 is controlled to a predetermined value, and eventually the amount of toner fed to the developing roller 22 is controlled to a desired value, as in the third example.

In addition, the detection signal detected by the light detection section 50 is fed to the control unit 53. The control unit 53 comprising an MPU unit, for example, can change the input value of the comparator 51 corresponding to the reference value in accordance with the detected toner color strength signal, the surface irregularities of a printing medium detected by a separate sensor or set manually, and the type of the printing medium (paper or film, for example), thereby intentionally changing the color strength of the toner, or changing the time constant of the control system to any desired value.

FIG. 17 shows an example of the developing roller. As shown in the figure, the developing roller has such a construction that a sponge roll is provided around a core metal, with the surface covered with a film tube.

When a developing solution containing a liquid toner having a viscosity as high as 400~4000 mPa·S, as in this invention, the wet type electrophotography apparatus should employ such a construction that a silicone oil having a lower viscosity than the silicone oil used in the liquid toner is applied as a prewetting solution layer on the surface of the photoconductive medium 10 to impart release properties to the photoconductive medium 10 to prevent the toner from being deposited on the non-exposed area thereof, with the developing roller 22 caused to make contact with the photoconductive medium 10 at such a contact pressure as not to destroy the prewetting solution layer.

For this reason, the developing device 14 should have such a construction that the liquid toner and the prewetting solution transported by the rotation of the photoconductive medium 10 and the developing roller 22 be passed through the contact area between the photoconductive drum 10 and the developing roller 22. At the same time, the hardness of the developing roller 22 must not be too high. More specifically, the hardness of the developing roller 22 should preferably be less than 60 degrees in terms of JIS-A hardness measurement. The lower the hardness of the developing roller 22, the more the liquid toner and the prewetting solution can pass through the contact area. In this regard, a sponge-like material is desirable for the purpose.

The higher the outside dimensional accuracy and the deflection accuracy during rotation of the developing roller 22, the more favorable because the pressure on the liquid layer can be maintained at a constant level. If the hardness of the developing roller 22 is low, it would become difficult to improve machining accuracy. The hardness and the outside dimensional accuracy of the developing roller 22 should therefore be properly balanced.

Furthermore, the higher the revolution of the developing roller 22, the more becomes the amount of liquids to pass the contact area between the developing roller 22 and the photoconductive medium 10, thereby relaxing pressure conditions. Too high revolution of the developing roller 22 would reduce the time for the application of an electrical field to the liquid toner, leading to the shortage of time necessary for the toner to migrate. Increasing the revolution of the developing roller 22 therefore has its limitation. The larger the diameter of the developing roller 22 the more becomes the amount of liquids to pass the contact area, thereby relaxing pressure conditions. But it makes it difficult to maintain outside dimensional accuracy.

Figure 10:
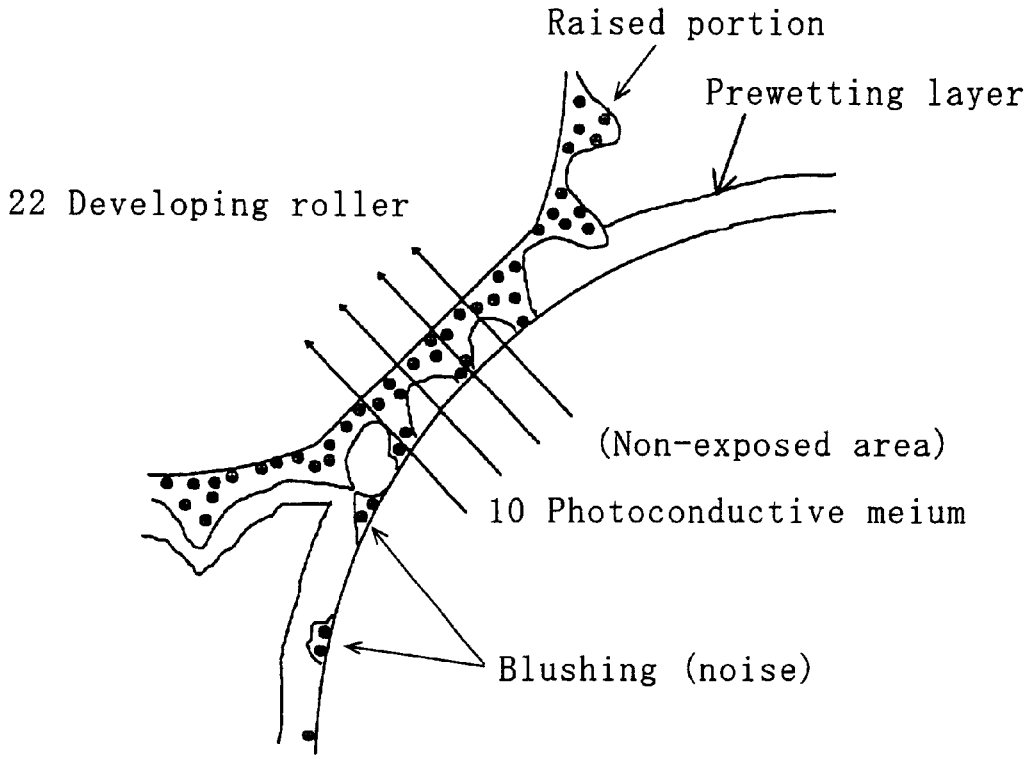
FIG. 10 is a diagram of assistance in explaining the operation of the prewetting solution layer on the surface of the photoconductive medium.
Figure 11:
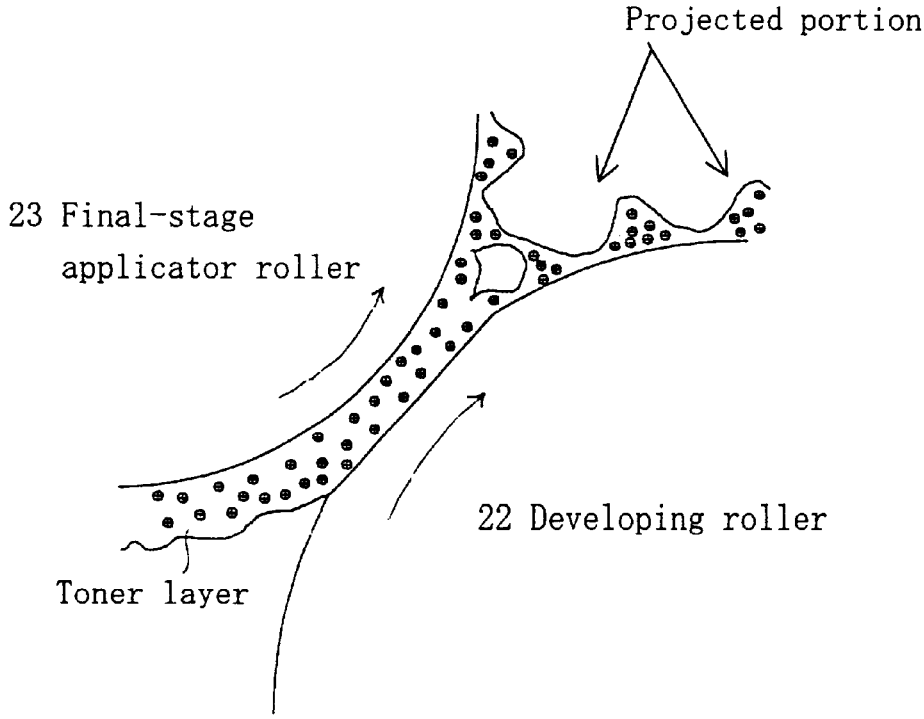
FIG. 11 is a diagram of assistance in explaining the state of the toner layer at the nip part between the developing roller and the applicator roller.

Furthermore, the surface of the toner layer applied to the developing roller 22 can be irregular because of the high viscosity of the toner. If this occurs, projected parts penetrate the prewetting solution layer to reach the surface of the photoconductive medium 10, causing noise on the non-exposed area, as shown in FIG. 10. Even in the exposed area, such an uneven layer may appear on the image area, leading to a poor image. To cope with this, the toner must be applied uniformly on the entire surface of the developing roller 22.

This invention uses an elastic soft roller more preferably a roller having a hardness of less than 60 degrees (JIS-A). The photoconductive medium (drum) 10 and the roller comes in close contact with each other (zero gap) when the drum is at a standstill. As the drum rotates, the drum and the roller receives buoyancy in accordance with the revolution of the drum due to the viscosity of the liquid and the elastic roller is deformed in accordance with the viscosity, with the result that a gap is formed between the drum and the roller, and a toner layer of a predetermined thickness is formed.

The elastic developing roller shown in FIG. 17 can accomplish this. Furthermore, since an electric field is applied to this elastic developing roller, the sponge roll and the film tube should be made electrically conductive, more preferably should be of a resistivity of $10^4$~$10^9$ Ω·cm, respectively. An EPT-51 (Asker F hardness 68 degrees), manufactured by Bridgestone Corp., can be used as the electrically conductive sponge, and an electrically conductive PFA tube (thick.: 30 microns) as the surface film tube. Typical size of the developing roller may be 32 mm in diameter, and 220 mm in barrel length, as shown in the figure.

Table 4 below shows the measurement results of the amount of liquid passage using this type of developing roller. In the table, DC344 is a silicone oil produced by Dow Corning.

TABLE 4

| Roller peripheral speed | Liquid | Amount of passage |
|---|---|---|
| 100 mm/s | DC344 (2.5 cSt) | 8 g · $m^2$ |
| | M-toner (400 mPa · S) | 20 g/$m^2$ |
| 250 mm/s | DC344 (2.5 cSt) | 13 g · $m^2$ |
| | M-toner (400 mPa · S) | 20 g/$m^2$ |

As is evident from the measurement results shown in the table, the amount of liquid passage per unit area is increased with increases in the peripheral speed of the roller.

By making the surface of the surface film tube coarser, to Rz1~10, for example, the toner can be transported by holding the toner in the recesses on the coarse roller surface, thereby increasing the adsorption of the toner.

Silicone rubber can be used as the elastic roller. Silicone rubber has a volume resistivity of about 104~109 Ω·cm, a hardness of 60 degrees (JIS-A), and good mechanical repulsion. The elastic roller can of course be made with silicone rubber alone, but should more preferably be made by combining silicone rubber with the aforementioned surface film tube.

FIG. 18 shows another example of such a developing roller. As shown in the figure, this developing roller has spacer rollers provided coaxially on both ends. The spacer rollers are provided to maintain the distance between the developing roller and the photoconductive medium (OPC drum) constant, and should basically have insulating properties. This can be made of an insulating resin, for example. To ensure accuracy, it can also be made of a metallic material, whose surface is coated with an insulating resin layer. The diameter of the spacer roller can be 31.8 mm for a 32-mm developing roller, for example. With this arrangement, the developing roller can press the photoconductive drum with a bite of 0.1 mm, thereby maintaining the pressure on the roller nip at an optimal level.

Figure 19:
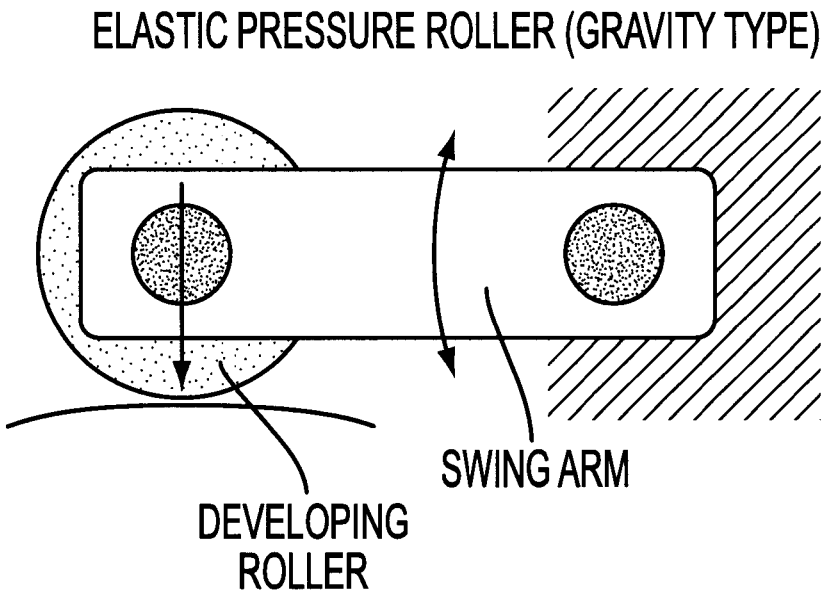
FIG. 19 shows an example of the developing roller that applies pressure by gravity.

Although an elastic roller is used as the developing roller in the embodiment described above, the embodiments shown in FIGS. 19 or 20 use a rigid roller or a roller having a given hardness as the developing roller. The developing roller shown in FIG. 19 applies pressure by the roller's own weight (by gravity). As shown in the figure, a swing arm cantilevered at one end from a support member in an almost horizontal direction has a developing roller at the other end, so that pressure is exerted onto the photoconductive drum by the developing roller's own weight.

Figure 20:
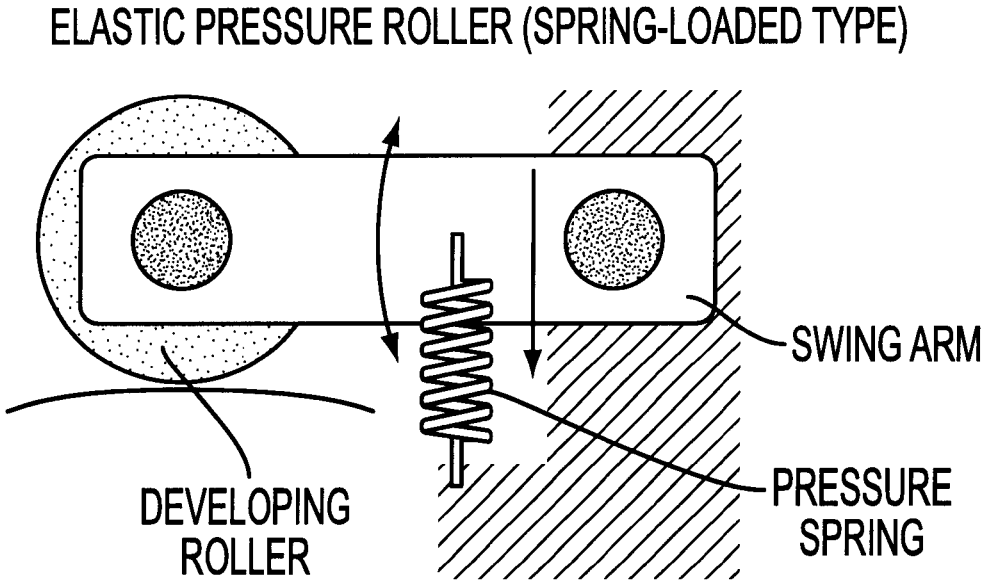
FIG. 20 shows an example of the developing roller that applies pressure by a spring.

FIG. 20 shows a developing roller which applies pressure by a spring, rather than the developing roller's own weight. As shown in the figure, the swing arm cantilevered at one end from the support member and having the developing roller at the other end has a spring between the swing arm and the support member in such a manner as to force the developing roller onto the photoconductive medium.

In this way, the developing roller forced onto the photoconductive medium by the developing roller's own weight or the spring makes contact with the photoconductive medium when it is at a standstill. As the drum is rotated, both the developing roller and the photoconductive medium receive a buoyancy in accordance with the revolution of the drum due to the viscosity of the liquid, and a gap in accordance with the developing roller's own weight or the force of the spring is formed between the developing roller and the photoconductive medium. Thus, a toner layer of a desired thickness can be formed.

Figure 21:
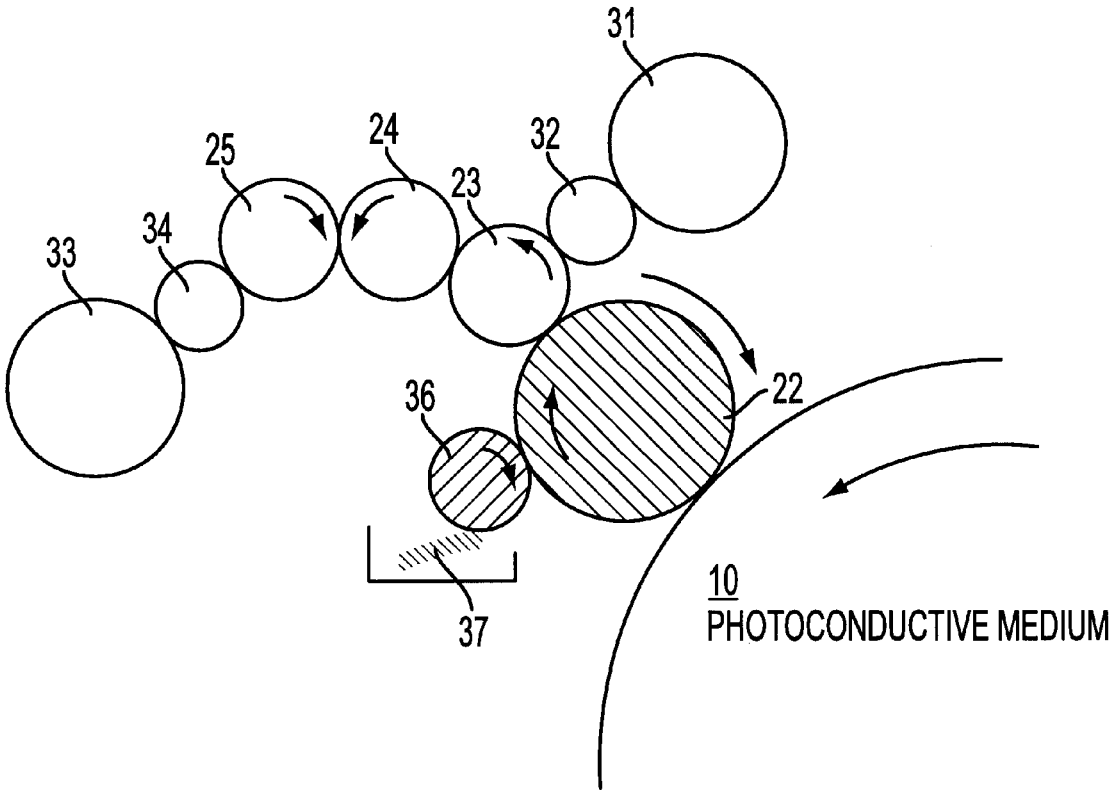
FIG. 21 shows the developing roller coming in contact with the photoconductive medium and a series of the applicator rollers for feeding a developing solution.

FIG. 21 shows the developing roller 22 coming in contact with the photoconductive medium, and a series of the applicator rollers 23~25 for feeding developing solution to the developing roller 22. In the example shown in the figure, a rigid reverse scraping roller 36 coming in contact with the developing roller 22 is provided. A drive motor 31 and a gear 32 are provided to drive the final-stage applicator roller 23, and a drive motor 34 and a gear 35 to drive the applicator roller 25.

The residual developing toner is scraped off from the developing roller 22 by rotating the rigid reverse scraping roller 36 coming in contact with the developing roller 22 in the reverse direction (the direction in which the surfaces of both rollers move in opposite direction with each other at the contact point of both rollers). By using such a reverse-direction roller 36, the residual developing toner can be stably recovered irrespective of the hardness of the roller. The toner adhering to the reverse scraping roller 36 is scraped off by a blade 37 coming in contact with the roller 36 and collected into a toner reservoir. The scraping effect of the reverse scraping roller can be improved by the force of an electrical field by applying voltage to the reverse scraping roller.

FIG. 22 is a diagram of assistance in explaining why the residual toner can be scraped off from a soft developing roller by using the reverse scraping roller. In the left hand of the figure shown is the prior art where a blade 37 is forced to the developing roller to scrape the residual toner. In this case, the edge surface of the blade has to be forced to the developing roller by exerting a given pressure to scrape off the residual toner from the developing roller. Even with this arrangement, a certain amount of toner cannot be prevented from slipping through the blade. When a reverse scraping roller is used, as shown in the right hand of the figure, on the other hand, the residual toner can be easily prevented from slipping through the nip portion between the developing roller and the reverse scraping roller by exerting a very low pressure.

The surface material of the reverse scraping roller, which is required to have good toner removal properties, should have good surface flatness.(surface roughness). For this reason, a rigid material, such as a metal or a rubber material having a hardness of more than 40 degrees, is generally preferred not only in toner removal properties but also in machinability.

To improve the residual toner removal effect of the reverse scraping roller when used in conjunction with the developing roller, the toner must be prevented from building up at the entrance of the nip portion, thereby increasing the pressure of the toner there, thus allowing the toner to enter and eventually slip through the nip portion. To this end, as much toner as possible has to be carried away in the opposite direction to prevent it from building up in the nip portion. The peripheral speed of the reverse scraping roller should preferably be at least twice the speed of the developing roller. It is difficult, however, to increase the peripheral speed ratio more than ten times because the ceiling of speed is limited by vibration in motor bearings, and the construction of the drive unit.

When an elastic roller having a relatively low hardness and a coarse surface roughness is used as the reverse scraping roller, it is possible to more thoroughly scrape off the toner because the toner holding power of the roller surface is increased. This is because the toner is entrapped in recesses on the coarse roller surface and carried away. The surface roughness in this case should preferably be more than Rz10. More preferably, an elastic roller having a rubber hardness of less than JIS-A 60 degrees, or a tube roller obtained by coating a sponge scraping roller with a film can be used.

An elastic soft roller, preferably having a hardness of less than 60 degrees (JIS-A), is recommended as a developing roller suitable for use in conjunction with the aforementioned reverse scraping roller. With this arrangement, both the photoconductive medium (drum) and the roller come in contact with each other (zero gap) when they are at a standstill. As the drum is rotated, both the developing roller and the photoconductive medium receive a buoyancy in accordance with the revolution of the drum due to the viscosity of the liquid, and the elastic roller is deformed in accordance with its elasticity. As a result, a gap is formed between the developing roller and the photoconductive medium. Thus, a toner layer of a desired thickness can be formed. A roller having such a construction that a sponge roll is provided around a core metal, with the surface covered with a film tube can be used as such an elastic roller.

Figure 23:
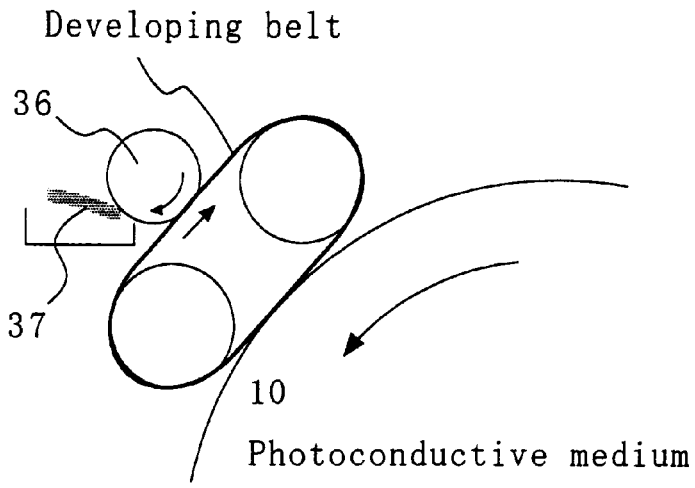
FIG. 23 shows the developing belt used in place of the developing roller shown in FIG. 21.

FIG. 23 shows an example where a developing belt is used in place of the developing roller shown in FIG. 21. A developing solution can be fed using a developing belt coming in contact with the photoconductive medium so that a double-layer construction with the prewetting solution film on the photoconductive medium. With this arrangement, positively charged toner particles in the developing solution can be deposited on the surface of the photoconductive medium in accordance with an electric field formed between the developing belt and the photoconductive medium. At this time, a rigid reverse scraping roller 36 is caused to make contact with the developing belt and rotate in the reverse direction, thereby scraping the residual toner from the developing belt, as in the previous example. The toner deposited on the reverse scraping roller 36 is scraped off by a blade 37 coming in contact with the roller 36 and collected in a toner reservoir.

Figure 24:
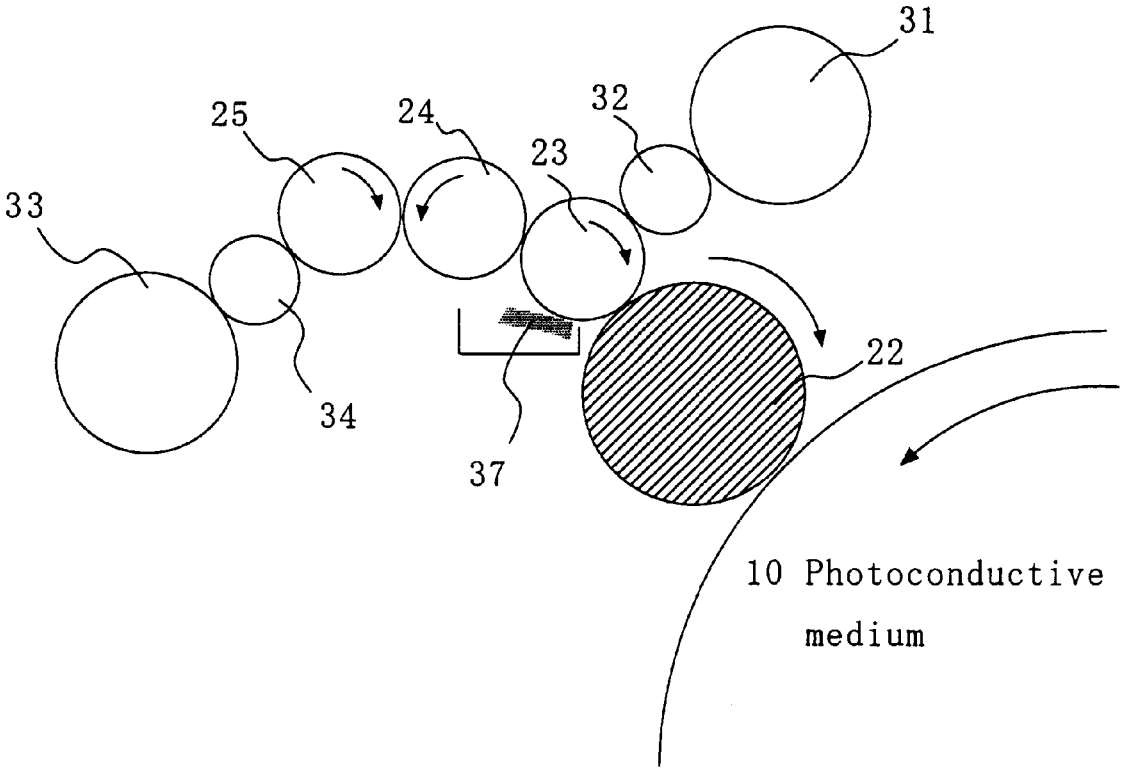
FIG. 24 is a diagram illustrating the case where the reverse roller for scraping and recovering the residual toner also serves as the final-stage applicator roller.
Figure 25:
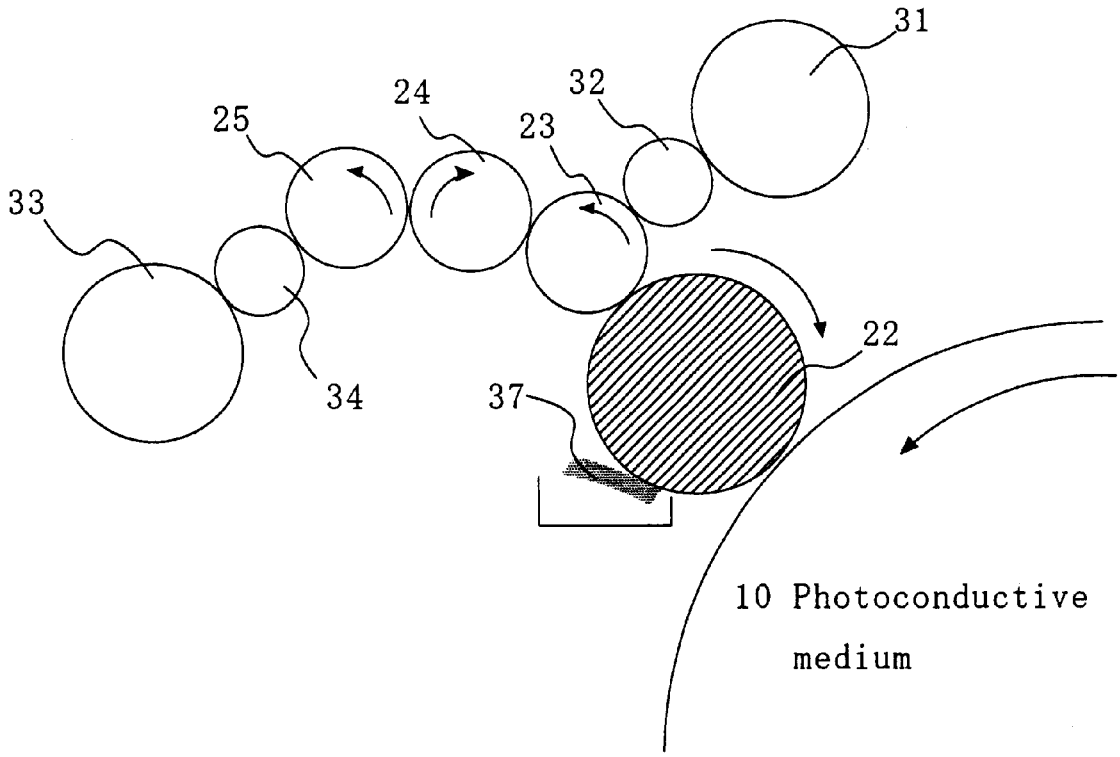
Fig. 25 Prior art
FIG. 25 shows the developing roller and a series of the applicator rollers for feeding the developing solution to it used in the prior art.

FIG. 24 shows an example where a final-stage applicator roller also serves as a reverse roller for scraping and collecting residual toner. This example has the same construction as the aforementioned example in that rollers 23~25 are applicator rollers and driven by drive motors 31 and 32, and gears 32 and 34, except that the final-stage applicator roller 23 is rotated in the reverse direction to the developing roller 22 so long as the contact area of both rollers are concerned.

This final-stage applicator roller 23 feeds the developing solution to the developing roller, and at the same time, scrapes the residual toner after development from the surface of the developing roller at a location beyond the contact area between both rollers. The scraped residual toner is scraped off by a blade 37 and collected in a toner reservoir.

Figure 26:
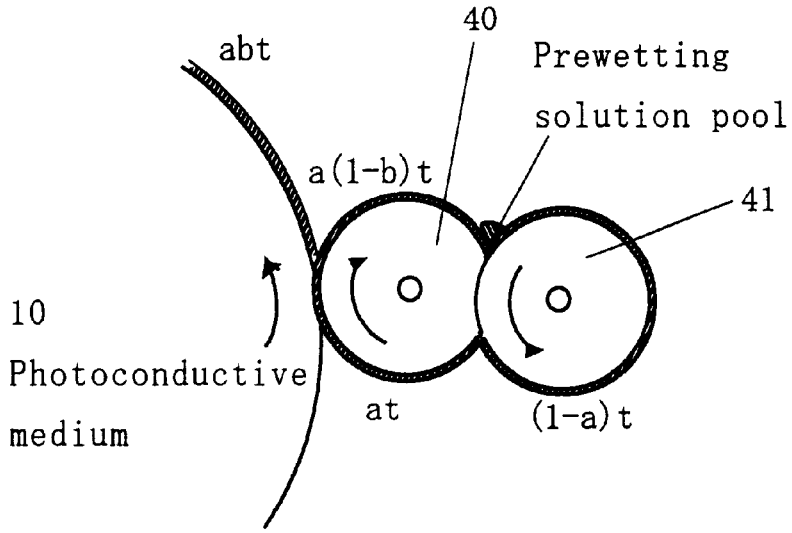
FIG. 26 illustrates the arrange of the roller that applies the prewetting solution to the photoconductive drum while making contact with the drum.

FIG. 26 illustrates an example where a prewetting solution is applied to the photoconductive medium (drum) 10 with a roller coming in contact with the photoconductive medium 10.

When a liquid toner having a viscosity as high as 400~4000 mPa·S is used as in this invention, a prewetting solution layer is applied to the surface of the photoconductive medium 10, while causing the developing roller to make contact with the photoconductive medium 10 at a pressure not to destroy the prewetting solution layer, to prevent the toner from depositing on the non-exposed area of the photoconductive medium 10 and to impart release properties to the photoconductive medium 10 so as to improve image quality by preventing toner blushing during development.

Although the prewetting solution is an insulating oil to be applied to the photoconductive medium 10 in a uniform thin film, the same liquid as the carrier agent used for the liquid toner can be used. The same silicone oil as that used for the liquid toner having a viscosity as low as about 2.5 cSt, for example, is applied to the surface of the photoconductive medium 10 in a thickness of 4~5 $\mu$m.

The prewetting solution feeding mechanism shown in FIG. 26 comprises a roller 40 rotated by making contact with the photoconductive drum 10, and a roller 41 rotated by the roller 40. An appropriate amount of prewetting solution is continuously trickled between the rollers 40 and 41 by other means, such as a pump, in such a manner as to form a prewetting solution pool between the rollers 40 and 41. The trickled prewetting solution is applied to the surface of the photoconductive medium 10 through the rotation of the rollers 40 and 41.

Since there is a pool of an appropriate amount of prewetting solution (PW) formed between the rollers 40 and 41, as shown in the figure, the amount of prewetting solution passing through both rollers is kept at a constant level. Now assume that the thickness of the prewetting solution layer is t. The prewetting solution layer thickness t is distributed at a ratio of at for the roller 40 to (1−a)t for the roller 41. In this way, since the amount of prewetting solution transported by the roller 40 is kept constant (at), the whole amount of prewetting solution is to be passed between the photoconductive medium 10 and the roller 40. In other words, no prewetting solution pool has to be formed.

The amount of prewetting solution passing between the rollers 40 and 41 can be adjusted by adjusting the state of contact, such as pressure, or pressing force exerted, between the rollers 40 and 41, that is, the relative position of the rollers 40 and 41, or the hardness of the rollers. A roller of a relatively low hardness is used for the roller 40 so as to ensure that the whole amount of prewetting solution on the roller 40 after the contact portion between the rollers 40 and 41. On the other hand, a roller of a relatively high hardness is used for the roller 41 coming in contact with the roller 40 of a low hardness to allow an appropriate amount of prewetting solution to be passed between the rollers 40 and 41. More specifically, EPDM (JIS-A hardness: 30 deg.) insulating rubber can be used for the roller 40, while ebonite (JIS-A hardness: over 90 deg.) for the roller 41.

As another example of the roller 40, an urethane sponge roller, whose surface is covered with an about 20 $\mu$m-thick polyimide film, can be used. The surface roughness of the polyimide film should preferably be approximately Rz0.2.

Figure 27:
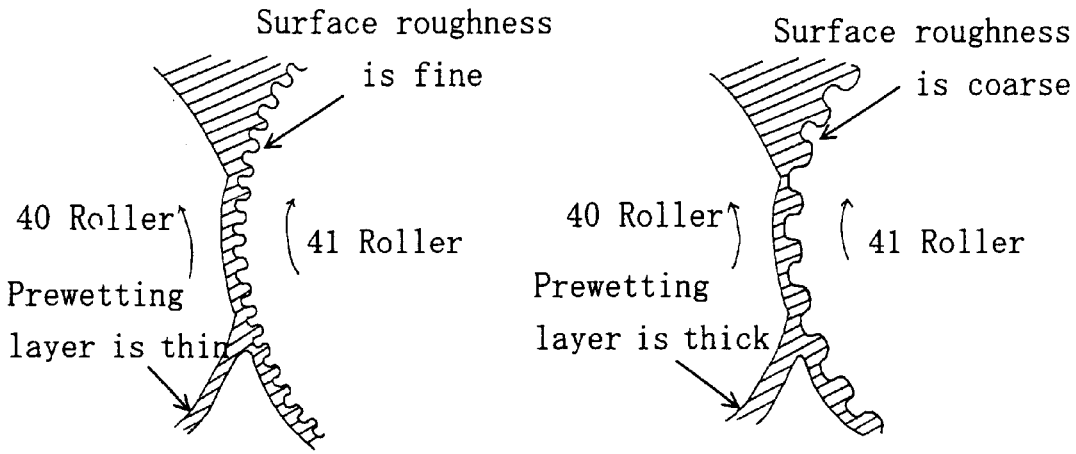
FIG. 27 shows in the left-hand figure the case where the surface roughness of the roller 41 is refined, and in the right-hand figure the case where the surface roughness is coarsened in the roller arrangement shown in FIG. 26.

FIG. 27 is a diagram of assistance in explaining another construction of the roller 41; the left-hand figure showing the case where the surface roughness of the roller 41 is reduced, and the right-hand figure the case where the surface roughness of the roller 41 is coarsened. As shown in the figure, the amount of prewetting solution passing through the contact portion between the rollers 40 and 41 can be adjusted by adjusting the amount of prewetting solution held in the recesses of the surface irregularities by adjusting the surface roughness of the roller 41. When the surface roughness of the roller 41 is coarsened to about Rz10, for example, the amount of prewetting solution passing through the roller contact portion and carried to the photoconductive medium 10 by the roller 40 is increased. When the surface roughness of the roller 41 is reduced to about Rz1, for example, the amount of prewetting solution passing through the roller contact portion and carried to the photoconductive medium 10 is reduced. As the roller 40, a material having a surface roughness of less than Rz1 is used to minimize variations in the layer thickness.

Table 5 below shows charge and exposure potentials on the photoconductive drum, with a roller having high insulating properties used as the roller 40. The case without the prewetting solution layer and the case where a roller having low insulating properties was used are also shown for comparison. The photoconductive medium was prewetted after statically charged and exposed. It is desirable that the charge and exposure potentials prior to prewetting be maintained during prewetting. As shown in Table 5 below, when a roller having high insulating properties was used, no appreciable drop in potential was found.

[Table 5] Measurement Results of Charge and Exposure Potentials on Photoconductive Drum Measuring Conditions:

Potentials were measured with a surface electrometer.

Photoconductive drum: Ø150, A–Si, drum peripheral speed (250 mm/s)

Roller 41: EPDM rubber roller

Roller 40: Foam urethane roller with a volume resistance of $10^{11}$ Ωcm as a roller having high insulating properties Foam urethane roller with a volume resistance of $10^{4}$ Ωcm as a roller having low insulating properties

| | Charge potential | Exposure potential |
|---|---|---|
| Without prewetting solution layer | Approx. 500 V | Approx. 180 V |
| Prewetting with a roller having low insulating properties | Approx. 400 V | Approx. 130 V |
| Prewetting with a roller having high insulating properties | Approx. 500 V | Approx. 180 V |

The amount of prewetting solution to be applied must be adjusted to the optimum level in accordance with the charging properties or mobility of the liquid toner used. When the prewetting solution applying means is of a type to apply the solution by bringing the roller into contact with the photoconductive medium 10, the amount of prewetting solution can be adjusted by changing the pressing force of the roller onto the photoconductive medium 10. The pressing force can be changed by changing the feed of the pulse motor for causing the roller to move relative to the photoconductive medium 10. This construction can serve as a roller retracting mechanism so that the roller can be retracted from the photoconductive medium 10 when the prewetting solution need not be applied.

Figure 28:
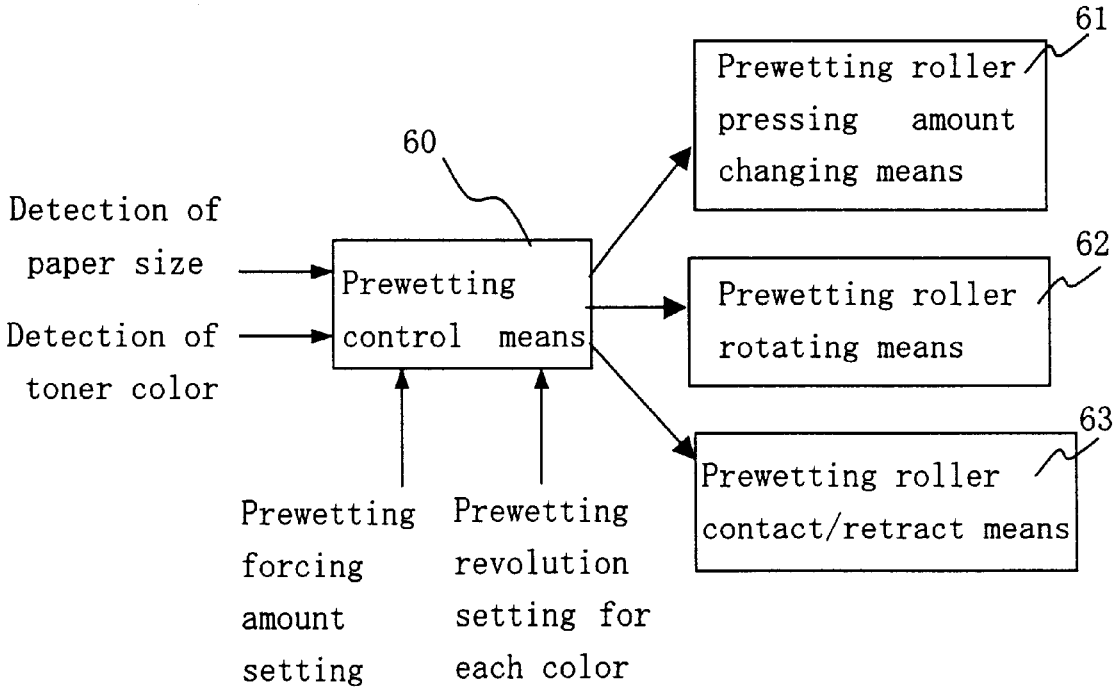
FIG. 28 is a block diagram showing the concept of prewetting control.

FIG. 28 is a block diagram showing the concept of prewetting control. A prewetting control means 60 detects the size of paper, and controls a prewetting roller contact/retract means 63 to apply the prewetting solution in accordance with the detected paper size. The prewetting control means 60 detects the toner color that is now being developed, and controls a prewetting roller pressing amount changing means 61 based on the prewetting roller pressing amount preset for each color. Furthermore, the prewetting control means 60 changes the peripheral speed of the prewetting roller for each color, detects the toner color that is now being developed and control a prewetting roller rotating means 62 based on the revolution of the prewetting roller preset for each color to adjust the thickness of the prewetting solution layer.

Figure 29:
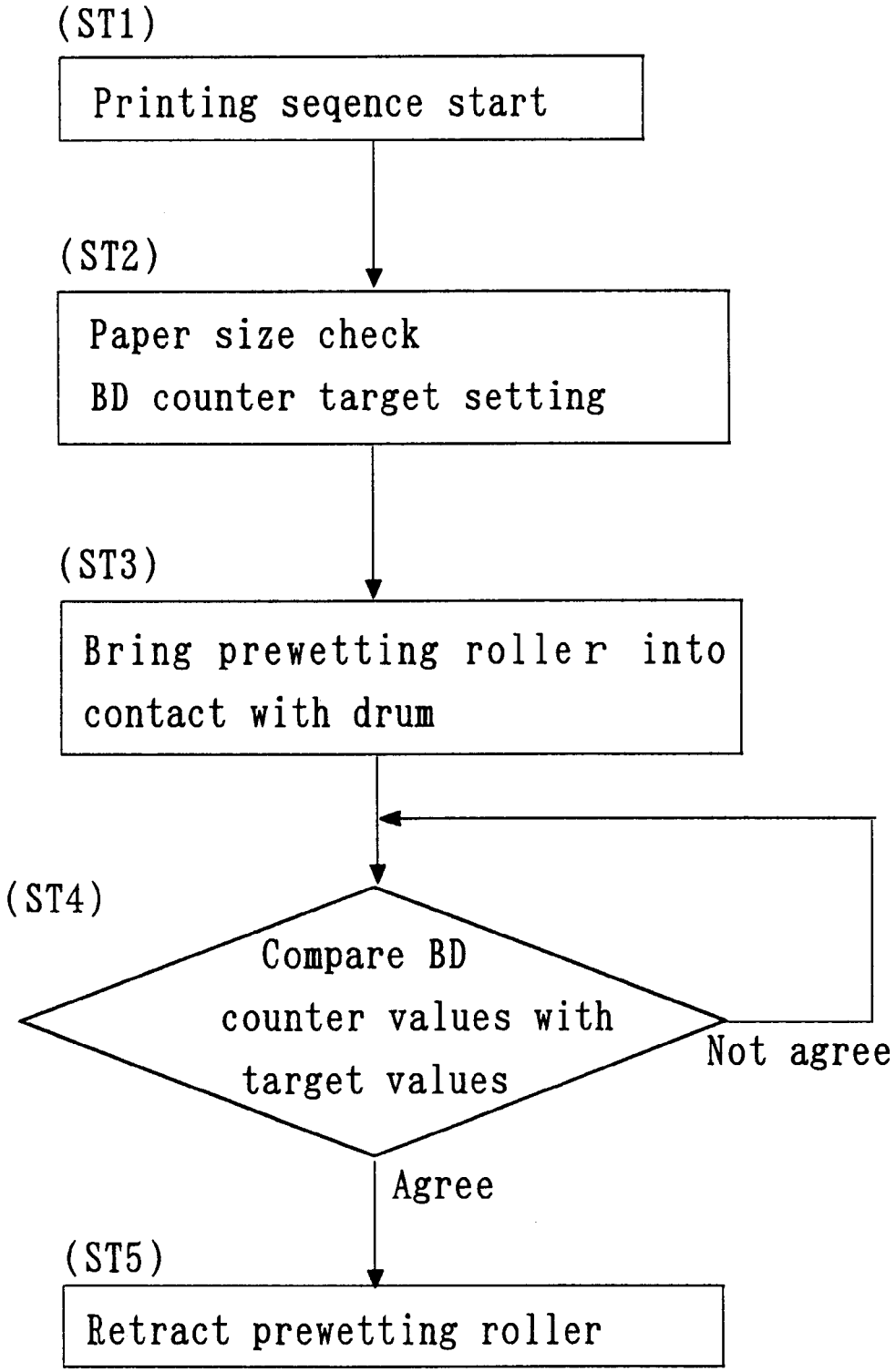
FIG. 29 is a flow chart of the operation of controlling the retracting mechanism of the prewetting roller.

FIG. 29 is a flow chart of the operation of controlling such a retracting mechanism. When printing is carried out on an A4-sized paper sheet on the photoconductive drum the entire surface of which corresponds to A3-sized paper, the prewetting solution suffice to be applied to a surface area of the photoconductive drum corresponding to the A4 size, not to the entire surface area. FIG. 29 shows the operation of changing the timing for retracting the prewetting roller in accordance with the size of paper to eliminate the application of the prewetting solution to the unnecessary surface area.

In Step 1, the printing sequence is started. In Step 2, the paper size is checked, a target for the paper size is set, and the beam detector (BD) counter is reset. In Step 3, the prewetting roller is brought into contact with the photoconductive drum. In Step 4, the contents of the BD counter that is updated in accordance with the rotation of the prewetting roller are compared with the set target, and if they do not agree with each other, the process is looped back, and if they agree with each other, then the prewetting roller is retracted in Step 5 based on the judgement that the prewetting roller has reached the preset target position.

Figure 30:
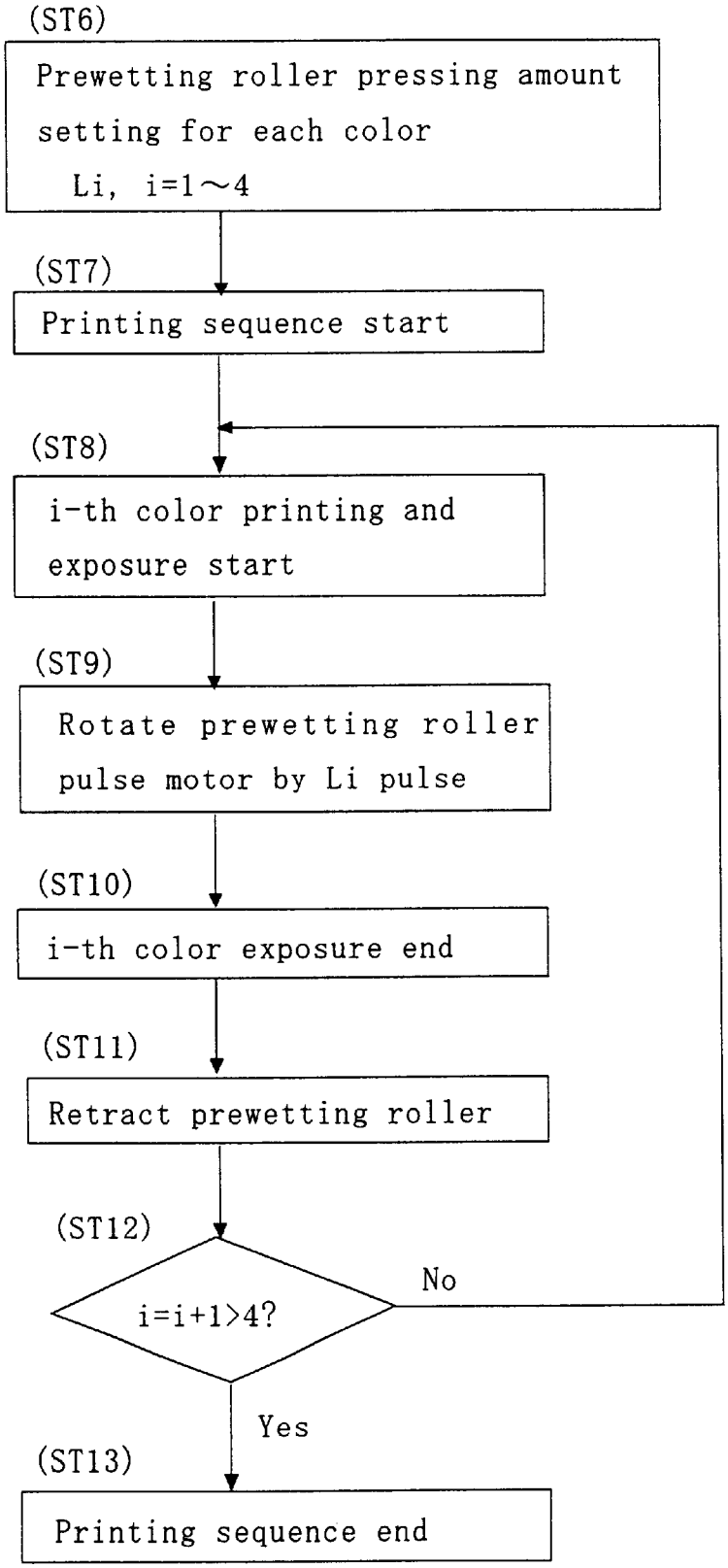
FIG. 30 is a flow chart of the operation of changing the film thickness by changing the pressing amount of the prewetting roller against the photoconductive drum 10.

FIG. 30 is a flow chart of the operation of changing the film thickness by changing the pressing amount of the prewetting roller onto the photoconductive drum 10. The viscosity, mobility, conductivity of the toner change in accordance with differences in toner colors. It is therefore necessary to control the thickness of the prewetting solution layer in accordance with the changes. If the viscosity of toner decreases in the order of yellow/magenta/cyan/black, for example, the thickness of the prewetting solution layer must be reduced accordingly. The thickness of the prewetting solution layer can be controlled by moving the prewetting roller relative to the photoconductive drum 10, and changing the number of feeding pulses of the pulse motor for changing the pressing amount of the prewetting roller onto the photoconductive drum.

In Step 6 in FIG. 30, the pressing amount of the prewetting roller is set for each color (i=1~4), and the number of pulse-motor feed pulses Li corresponding thereto is also set. In Step 7, printing sequence is started. In Step 8, light exposure is started first to print the first color. In Step 9, a pulse motor for bringing the prewetting roller in contact with the photoconductive drum 10 is caused to rotate by Li pulses as set earlier. In Step 10, exposure for the i-th (first, in this case) color is completed. In Step 11, the prewetting roller is retracted. In Step 12, i is incremented to judge whether this exceeds 4 of the four colors in order to see if light exposure has been completed for all colors. If exposure has not been completed for all colors, the operation is returned to Step 8 to start exposure for printing the next color. If light exposure for all colors has been completed, the operation proceeds to Step 13, and the printing sequence is terminated.

Figure 31:
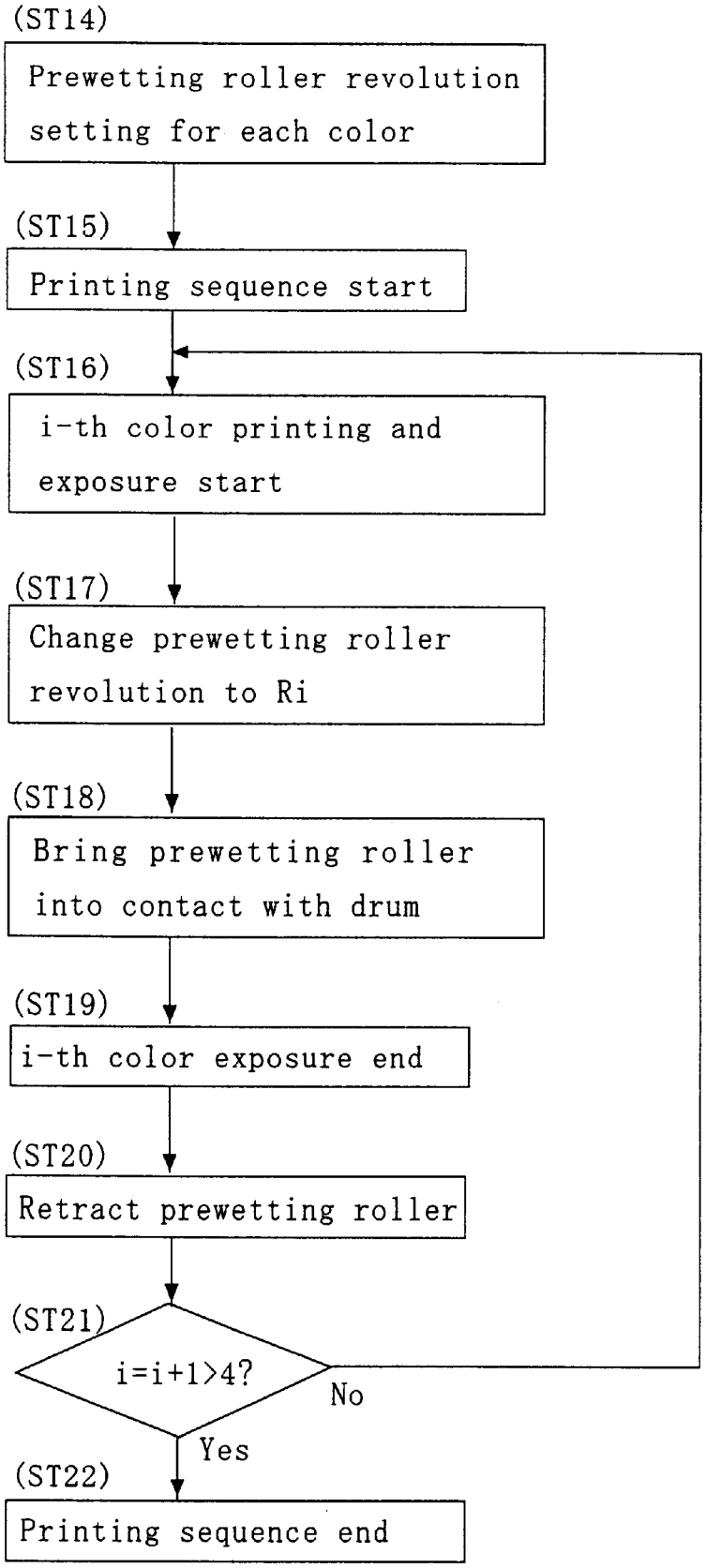
FIG. 31 is a flow chart of the operation of changing the difference in peripheral speed between the prewetting roller and the photoconductive drum 10 to control film thickness.

FIG. 31 is a flow chart of the operation to change the difference in peripheral speed between the prewetting roller and the photoconductive drum 10 to control the film thickness. By changing the peripheral speed of the prewetting roller, a difference in peripheral speed with the photoconductive drum 10 can be caused, and thereby the amount of application of prewetting solution can be changed.

In Step 14 in FIG. 31, the revolution of the prewetting roller is set for each color. In Step 15, printing sequence is started. In Step 16, light exposure is started for the i-th color. In Step 17, the revolution of the prewetting roller is changed to Ri. In Step 18, the prewetting roller is brought into contact with the photoconductive drum 10. In Step 19, light exposure for the i-th color is terminated. In Step 20, the prewetting roller is retracted. In Step 21, i is incremented to compare with 4 of the four colors to see if i exceeds it in order to judge whether light exposure is completed for all colors. If exposure has not been completed for all colors, the operation is returned to Step 16 to start light exposure for the next color. Upon completion of light exposure for all colors, the operation proceeds to Step 22 to terminate the printing sequence.

Figure 32:
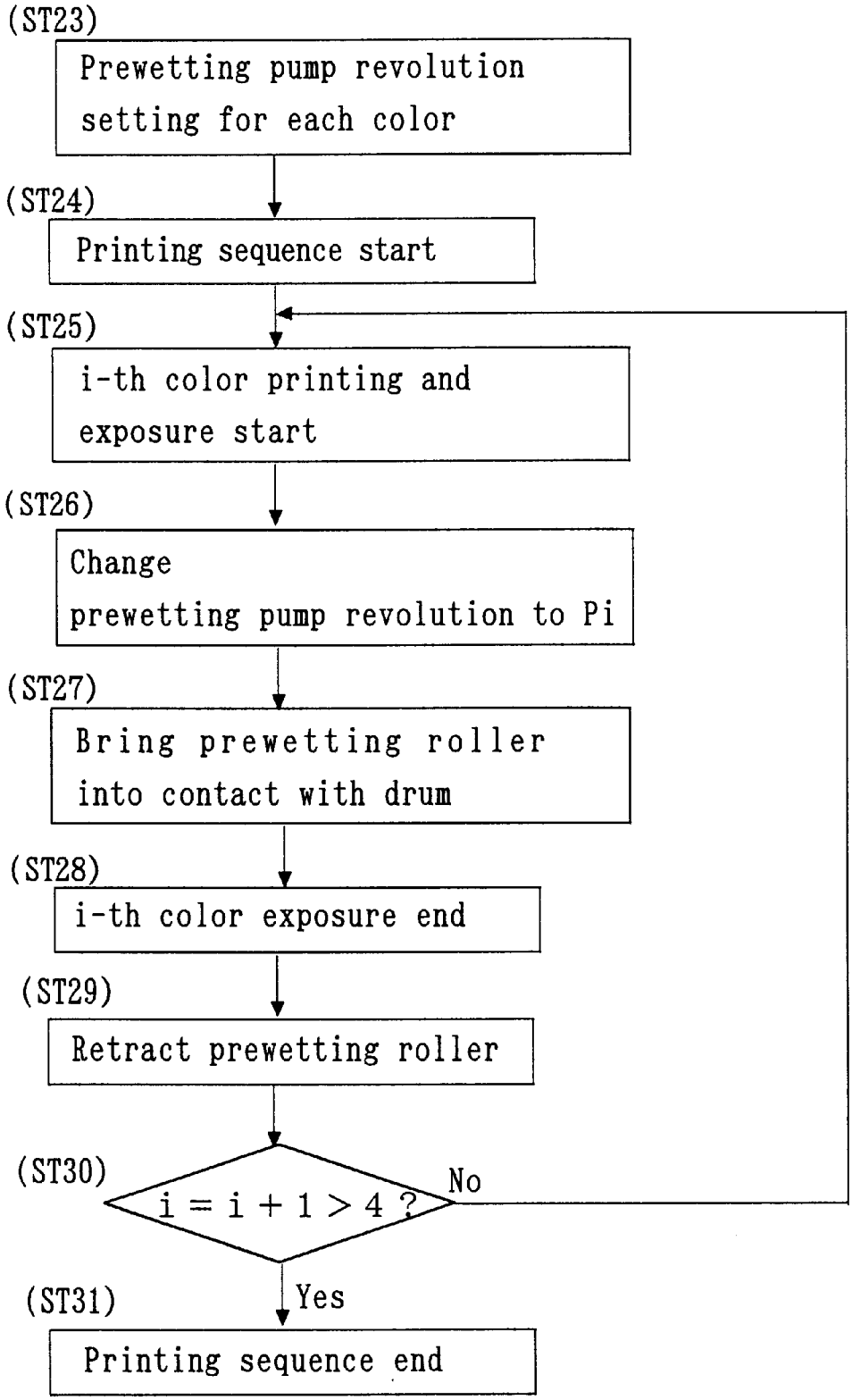
FIG. 32 is a flow chart of the operation of changing the rotation of the prewetting pump to control film thickness.

FIG. 32 is a flow chart of the operation to change the revolution of the prewetting pump to control the film thickness. By changing the feed of prewetting solution to the prewetting roller, the amount of application of prewetting solution can be changed. In this example, the prewetting solution feed control means is used to control the amount of application of the prewetting solution, rather than controlling the flow of the prewetting solution relying on the state of contact between the two rollers.

In Step 23 in FIG. 32, the revolution Pi of the prewetting pump is set for each color. In Step 24, printing sequence is started. In Step 25, light exposure for printing the i-th color is started. In Step 26, the revolution of the prewetting pump is changed to Pi. In Step 27, the prewetting roller is brought into contact with the photoconductive drum. In Step 28, light exposure for the i-th color is terminated. In Step 29, the prewetting roller is retracted. In Step 30, i is incremented to compare with 4 of the four colors to see if i exceeds it in order to judge whether exposure is completed for all colors. If light exposure has not been completed for all colors, the operation is returned to Step 25 to start light exposure for the next color. If exposure has been completed for all colors, the operation proceeds to Step 31 to terminate the printing sequence.

Figure 33:
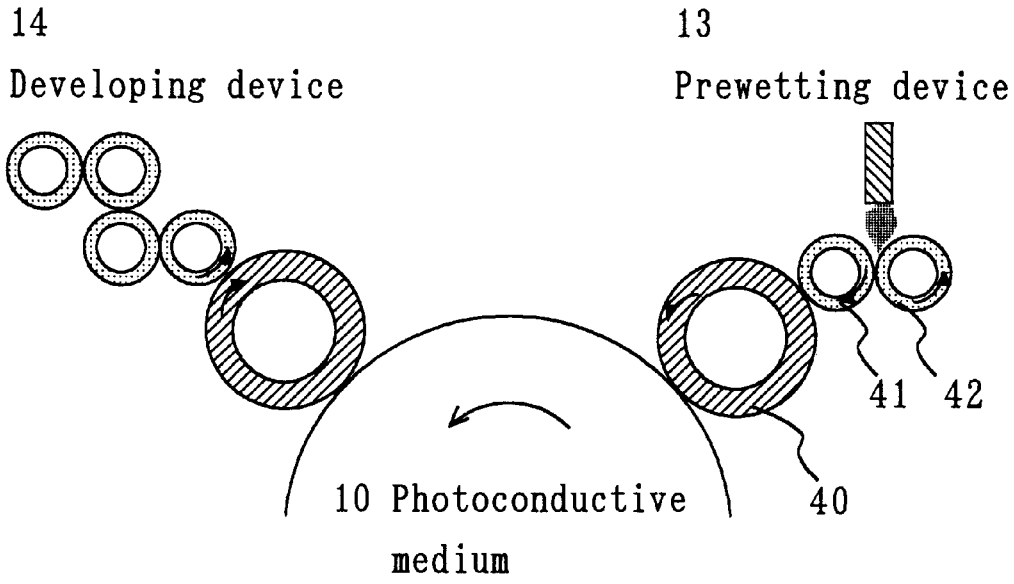
FIG. 33 is a diagram showing an example of the prewetting device.

FIG. 33 is a diagram illustrating an example of the prewetting device to which this invention is applied. The prewetting device 13 shown in the figure carries out prewetting treatment immediately before the development treatment carried out by the developing device 14. The prewetting device 13 comprises a prewetting roller coming in contact with the photoconductive medium 10, first and second auxiliary rollers 41 and 42 coming in contact with the prewetting roller 40, and a prewetting solution inlet for introducing the prewetting solution in the portion where the two auxiliary rollers come in contact with each other.

The prewetting roller 40 shown in the figure is caused to rotate in the reverse direction to the photoconductive medium 10 (i.e., the surfaces in the nip portion moving in the reverse direction with each other) by a drive means (not shown). The number of the auxiliary rollers are not limited to two, and may be any appropriate number necessary for spreading the prewetting solution into a thin, uniform film on the prewetting roller 40. The auxiliary roller 41, and the roller 42 are normally rotated in the forward direction while making contact with the prewetting roller 40.

When the prewetting solution is applied in a thin layer on the photoconductive medium 10 by the prewetting roller 40, fine variations in the prewetting solution or rivulets, are caused due to changes in the balance among the viscosity and feed of the prewetting solution, roller revolution, etc. By causing the prewetting roller in the reverse direction, however, fine variations (streaks) can be reduced without causing shear and separation.

The reason why fine variations (streaks) are reduced by causing the prewetting roller 40 to rotate in the reverse direction to the photoconductive medium 10 with respect to the nip portion is almost the same as that described in connection with the application of the developing solution to the developing roller 22, referring to FIG. 9. That is, as the two rollers (the prewetting roller and the photoconductive medium) that rotate in the forward direction are brought into contact with each other and then separated, local concentrations of the prewetting solution occur, leading to streaks on the photoconductive medium, with almost no prewetting solution left between the streaks.

Figure 35:
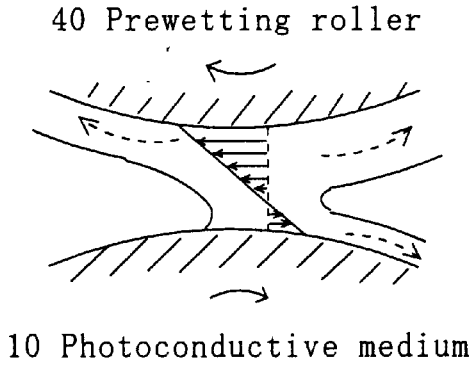
FIG. 35 is a diagram of assistance in explaining the speed profile of the prewetting solution between the prewetting roller and the photoconductive medium that are rotated in the opposite direction to each other.
Figure 36:
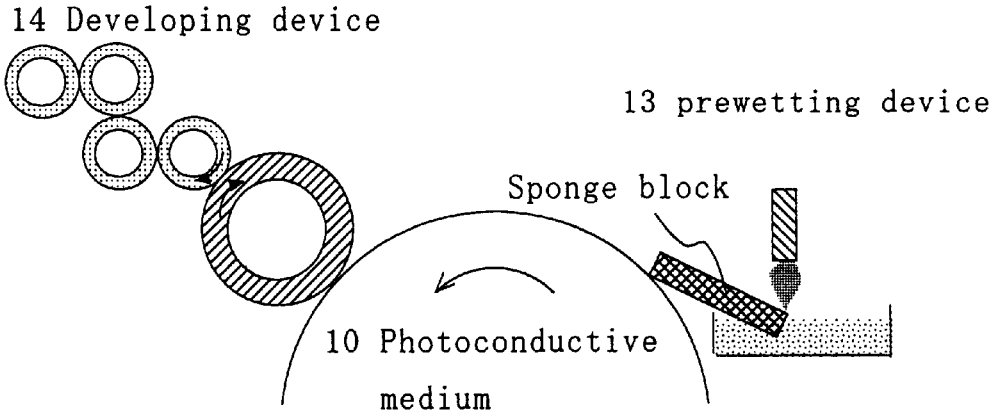
Fig. 36 Prior art
FIG. 36 is a diagram of assistance in explaining the method of applying the prewetting solution using the sponge block of the prior art.
Figure 37:
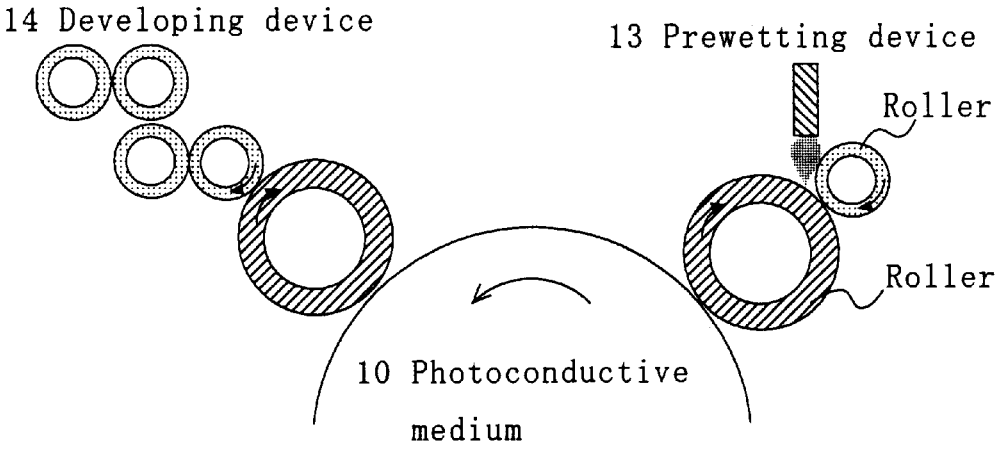
Fig. 37 Prior art
FIG. 37 is a diagram of assistance in explaining the method of applying the prewetting solution using the roller train of the prior art.

These streaks can be reduced by causing the prewetting roller 40 to rotate in the reverse direction to the photoconductive medium 10 with respect to the nip portion. FIG. 35 is a diagram of assistance in explaining the speed profile of the prewetting solution between the prewetting roller and the photoconductive medium when both rollers are rotated in the reverse direction to each other with respect to the nip portion. The prewetting solution in the nip portion of both rollers is dragged by each roller and moved in the opposite direction to each other. The length and direction of solid-line arrows in the figure denote the speed and direction of the moving toner at their respective locations. Somewhere in the internal layer between the two rollers lies the point of zero speed. At this zero speed point, the prewetting solution is sheared and separated.

When both rollers are rotated in the same direction with respect to the nip portion, the prewetting solution is sheared and separated, but this shear, deformation and separation causes the viscosity of the prewetting solution to lower, improving the fluidity of the solution and leading to reduced rivulets. The speed difference in the rotation in the reverse direction should be more than three times to achieve the best effect, with the upper limit of the speed difference being about ten times due to limiting factors such as the durability and vibration of motor bearings.

To achieve the formation of a uniform layer by rotating the rollers in the reverse direction, it is necessary to form a gap almost equal to the aimed layer thickness between the rollers. It is difficult, however, to guarantee this in terms of mechanical dimensional accuracy because the thickness of the prewetting solution layer on the photoconductive medium 10 is as thin as about 1~20 microns. This can be achieved only by forming a dynamic gap by the soft roller and the viscous fluid by using a soft roller.

Requirements for forming this dynamic gap include forming a given gap between the rollers, the presence of a zero-speed profile in the internal layer, and a relatively high viscosity prewetting solution. Furthermore, the amount of prewetting solution on the photoconductive medium from the zero-speed point must satisfy the aimed prewetting solution layer thickness of 1~20 microns, as described above. This invention can maintain the balance among them and form a uniform prewetting solution layer at a predetermined gap.

The effect of the rotation of the prewetting roller in the reverse direction on maintaining the amount of prewetting solution uniform is affected by to what extent the surface of the prewetting roller can retain the prewetting solution. When a rubber roller (solid urethane rubber, for example) having a surface as smooth as less than Rz4 is used, the smoothness of the prewetting roller surface is considered to be transferred onto the surface of the photoconductive drum. As a result, the uniformity of the amount of prewetting solution on the photoconductive medium is improved.

The speed profile between the rollers is affected by the ability for the roller surface to allow prewetting solution to be passed at a low pressure. That is, the lower the hardness of the roller is, the better effect can be achieved with a low viscosity prewetting solution. To reduce the hardness of the roller, a sponge roller (foam urethane (Asker F 68 degrees), for example) covered with a seamless film (PFA 30 $\mu$m, for example) can be used.

Although the photoconductive medium 10 of a drum shape is used in the above embodiments, a belt can be used in place of the drum. By providing two or more rollers inside the belt, the belt can be driven on these rollers. The belt driven in this way can make contact with the prewetting roller at low pressure between the rollers inside the belt. Thus, similar effects to the use of a low hardness roller can be expected.

Figure 34:
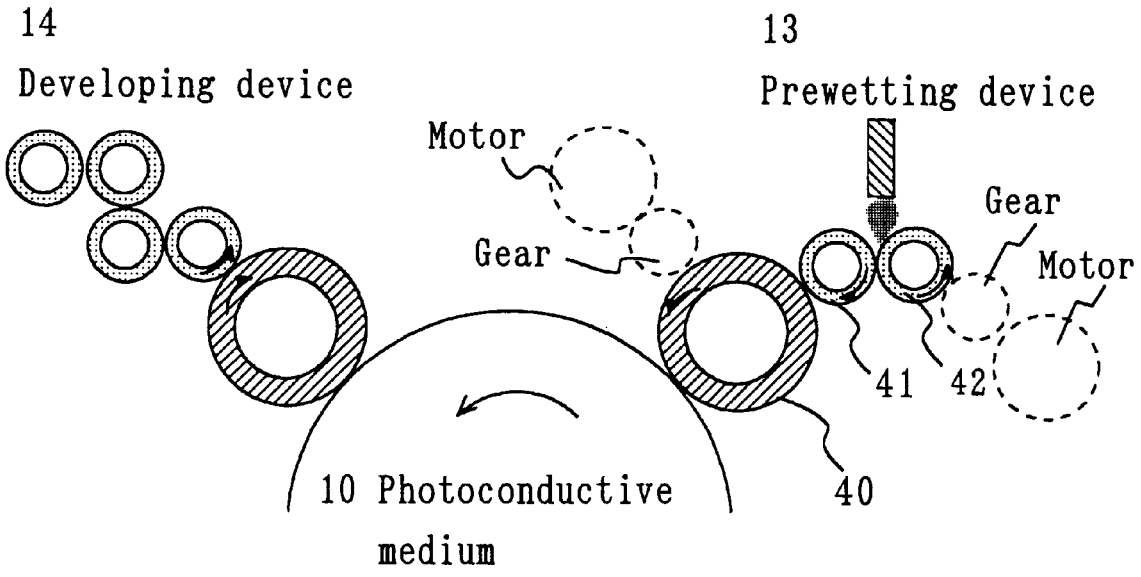
FIG. 34 is a diagram showing another example of the prewetting device where the prewetting roller is driven by a different arrangement.

FIG. 34 is a diagram illustrating another example of the driving mechanism of the prewetting roller in the prewetting device to which this invention is applied. In the figure, the prewetting roller 40 and an auxiliary roller 42 are independently driven via separate drive motors and gears. With this arrangement, the prewetting roller 40 can select the optimum speed for maintaining a uniform prewetting solution layer thickness, while the speed of the auxiliary roller can be selected independently as a measurement section for determining the thickness of the prewetting solution layer. The thickness of the prewetting solution layer becomes thicker by increasing the speed of the auxiliary roller.

INDUSTRIAL APPLICABILITY

As described above, this invention makes it possible to feed and apply a developing solution uniformly onto the developing roller, carry out high-quality development without blushing by applying a prewetting solution film uniformly on the photoconductive medium, and stably recover the residual toner layer after development on the developing roller, in a wet type electrophotography apparatus using a non-volatile, high-viscosity liquid toner.

What is claimed is:

1. A wet type electrophotography apparatus using a non-volatile, high-viscosity, high-concentration liquid toner as a developing solution, comprising:

an image carrier on which an electrostatic latent image is formed;

a prewetting device to perform prewetting treatment by applying a prewetting solution to said image carrier before or after light exposure treatment; and a developing device to deposit toner particles on said image carrier by contacting said image carrier, wherein said prewetting device includes a prewetting solution applicator roller rotating in contact with said image carrier, and causes said prewetting solution applicator roller to move in a direction opposite to a direction of movement of said image carrier at the contact point of said image carrier and said prewetting solution applicator roller to keep the prewetting solution layer uniform.

2. A wet type electrophotography apparatus as set forth in claim 1, wherein said prewetting solution applicator roller comprises a rubber roller having a surface roughness of less than Rz4 $\mu$m.

3. A wet type electrophotography apparatus as set forth in claim 1, wherein said prewetting solution applicator roller comprises a sponge roller which is covered with a seamless film.

4. A wet type electrophotography apparatus as set forth in claim 1, wherein a difference in speed between said image carrier and said prewetting solution applicator roller moving in the opposite direction to each other is set to not less than three times and less than ten times.

5. A wet type electrophotography apparatus as set forth in claim 1, further comprising a roller interconnected with said prewetting solution applicator roller, wherein an amount of said prewetting solution applied, and a layer thickness thereof, are accomplished simultaneously by driving independently said prewetting solution applicator roller and said roller interconnected with said prewetting solution applicator roller.

6. A wet type electrophotography apparatus using a non-volatile, high-viscosity, high-concentration liquid toner as a developing solution, comprising:

an image carrier on which an electrostatic latent image is formed;

a developing roller to feed said developing solution via a surface contacting said image carrier and causing toner particles in said developing solution to deposit on said image carrier;

a developing solution applying device to transport and apply said developing solution to said developing roller, the developing solution applying device comprising a plurality of interconnecting rotating rollers to spread said developing solution, the plurality of interconnecting rotating rollers including a final-stage rotating roller, wherein a film of said developing solution on a surface of said final stage rotating roller is applied to said contact surface of said developing roller; and an electrically conductive roller provided independently of said final-stage rotating roller, said electrically conductive roller rotating in contact with said developing roller, wherein a bias voltage is fed to said electrically conductive roller to apply a film of said developing solution on the surface of said final-stage rotating roller to said contact surface of said developing roller in accordance with an electrical field formed between said electrically conductive roller and said developing roller by said bias voltage.

7. A wet type electrophotography apparatus using a non-volatile, high-viscosity, high-concentration liquid toner as a developing solution, comprising:

an image carrier on which an electrostatic latent image is formed;

a developing roller to feed said developing solution via a surface contacting said image carrier and causing toner particles in said developing solution to deposit on said image carrier;

a developing solution applying device to transport and apply said developing solution to said developing roller, the developing solution applying device comprising a plurality of interconnecting rotating rollers to spread said developing solution, including a final stage rotating roller, wherein a film of said developing solution on a surface of the final-stage rotating roller is applied to said contact surface of said developing roller; and an electrically conductive blade contacting said developing roller, and a bias voltage is fed by said electrically conductive blade to form an electrical field to cause toner particles to deposit on said developing roller.

8. A wet type electrophotography apparatus using a non-volatile, high-viscosity, high-concentration liquid toner as a developing solution, comprising:

an image carrier on which an electrostatic latent image is formed;

a developing roller to feed said developing solution via a surface contacting said image carrier and causing toner particles in said developing solution to deposit on said image carrier;

a developing solution applying device comprising a plurality of interconnecting rotating rollers to transport and apply said developing solution to said developing roller while spreading with said interconnecting rotating rollers, the plurality of interconnecting rotating rollers including a final-stage rotating roller contacting said developing roller and moving in an opposite direction to movement of said developing roller at a contact point to apply a film of said developing solution on the surface of said final-stage rotating roller to said contact surface of said developing roller.

9. A wet type electrophotography apparatus as set forth in claim 8, wherein said final-stage rotating roller comprises a rubber roller having a low hardness and a coarse surface roughness.

10. A wet type electrophotography apparatus as set forth in claim 8, wherein said final-stage rotating roller comprises an elastic tube roller including a sponge roller covered with a film.

11. A wet type electrophotography apparatus as set forth in claim 8, wherein said final-stage rotating roller comprises a metallic roller having a high hardness and a smooth surface.

12. A wet type electrophotography apparatus as set forth in claim 8, wherein a bias voltage is fed to said final-stage rotating roller.

13. A wet type electrophotography apparatus as set forth in claim 8, further comprising a roller which is brought in contact with said developing roller, independently of said final-stage rotating roller, said roller moving in the opposite direction to said developing roller at a contact point.

14. A wet type electrophotography apparatus using a non-volatile, high-viscosity, high-concentration liquid toner as a developing solution, comprising:

an image carrier on which an electrostatic latent image is formed;

a developing roller to feed said developing solution via a surface contacting said image carrier and causing toner particles in said developing solution to deposit on said image carrier;

a developing solution applying device comprising a plurality of interconnecting rotating rollers to transport and apply said developing solution to said developing roller while spreading with said interconnecting rotating rollers, the plurality of interconnecting rotating rollers including a final-stage rotating roller contacting said developing roller, wherein a bias voltage is fed to said final-stage rotating roller to apply a layer of said developing solution on a surface of said final-stage rotating roller to said contact surface of said developing roller in accordance with an electrical field formed by said bias voltage between said final-stage rotating roller and said developing roller; and a monitoring device to monitor the thickness of said developing solution layer applied to the surface of said final-stage rotating roller and controlling said layer thickness to a predetermined value.

15. A wet type electrophotography apparatus as set forth in claim 14, wherein said layer thickness is controlled by controlling the peripheral speed of rotating rollers of said developing solution applying device to make the feed of said developing solution variable.

16. A wet type electrophotography apparatus as set forth in claim 14, wherein said developing solution applying device comprises a first-stage rotating roller and a next-stage rotating roller, and said layer thickness is controlled by applying an electrical field between said first-stage rotating roller and said next-stage rotating roller and controlling the intensity and direction of said electrical field.

17. A wet type electrophotography apparatus as set forth in claim 14, wherein said layer thickness is controlled by controlling a gap or contact pressure between said rotating rollers of said developing solution applying device.

18. A wet type electrophotography apparatus as set forth in claim 17, wherein said rotating rollers further comprise roller shafts having roller bearings and a piezoelectric element on said roller bearings, wherein said gap or contact pressure between said rotating rollers is controlled by causing roller shaft positions to move via said piezoelectric element on said roller bearings.

19. A wet type electrophotography apparatus as set forth in claim 17, wherein said gap or contact pressure between said rotating rollers is controlled independently on right and left sides so that the respective thicknesses of said developing solution on the right and left sides of said final-stage roller in the longitudinal direction become substantially equal.

20. A wet type electrophotography apparatus as set forth in claim 14, wherein a surface of said final-stage rotating roller is light-reflective, and said layer thickness is monitored by detecting the color strength of toner on said light-reflective surface based on the reflection of light irradiated on said light-reflective surface by a light source.

21. A wet type electrophotography apparatus using a non-volatile, high-viscosity, high-concentration liquid toner as a developing solution, comprising:

an image carrier on which an electrostatic latent image is formed;

a prewetting solution applying device to apply a prewetting solution to said image carrier, said prewetting solution applying device comprising a prewetting solution applicator roller rotating in contact with said image carrier and having high insulation properties, and at least one interconnecting contact roller rotating in contact with said applicator roller, wherein a thickness of a layer of said prewetting solution is controlled to a predetermined thickness by feeding said prewetting solution in an amount which builds up a prewetting solution pool between said prewetting solution applicator roller and said contact roller, and adjusting a state of contact between the applicator roller and the contact roller to adjust the amount of said prewetting solution passing between the rollers; and a developing device to feed a film of a liquid toner as a developing solution on said image carrier while maintaining a double-layer construction with said prewetting solution layer applied to said image carrier by said prewetting solution applying device, and causing toner particles to deposit on said image carrier in accordance with an electrical field formed between said developing device and said image carrier.

22. A wet type electrophotography apparatus as set forth in claim 21, wherein said prewetting solution applicator roller has a low hardness, and the at least one interconnecting contacting roller rotating in contact with said prewetting solution applicator roller has a high hardness.

23. A wet type electrophotography apparatus as set forth in claim 21, wherein said prewetting solution applicator roller has a small surface roughness to eliminate variations in the layer thickness on said image carrier, and the layer thickness of said prewetting solution on said image carrier is adjusted by adjusting the surface roughness of said interconnecting contact roller.

24. A wet type electrophotography apparatus as set forth in claim 21, wherein said prewetting solution applicator roller comprises a sponge having a roller shape and a film having high insulating properties to cover said sponge.

25. A wet type electrophotography apparatus as set forth in claim 21, further comprising a control device to control said prewetting solution applying device to adjust the layer thickness of said prewetting solution on said image carrier in accordance with the type of liquid toner selected from among a plurality of liquid toners.

26. A wet type electrophotography apparatus as set forth in claim 25, wherein said control device adjusts the layer thickness of said prewetting solution on said image carrier by controlling the revolution of said prewetting solution applicator roller.

27. A wet type electrophotography apparatus as set forth in claim 25, wherein said control device adjusts the layer thickness of said prewetting solution on said image carrier by controlling the pressure exerted by said prewetting solution applicator roller onto said image carrier.

28. A wet type electrophotography apparatus as set forth in claim 21, further comprising a retracting device to retract said prewetting solution applicator roller that rotates in contact with said image carrier, and a control device to operate said retracting device to control the range of applying said prewetting solution to said image carrier.

* * * * *

UNITED STATES PATENT AND TRADEMARK OFFICE

CERTIFICATE OF CORRECTION

PATENT NO. : 6,311,034 B1
DATED : October 30, 2001
INVENTOR(S) : Yutaka Nakashima et al.

It is certified that error appears in the above-identified patent and that said Letters Patent is hereby corrected as shown below:

Title page,
Item [75], change "Shigrki" to -- Shigeki --.

Column 2,
Line 48, delete "but".

Figure 17A:
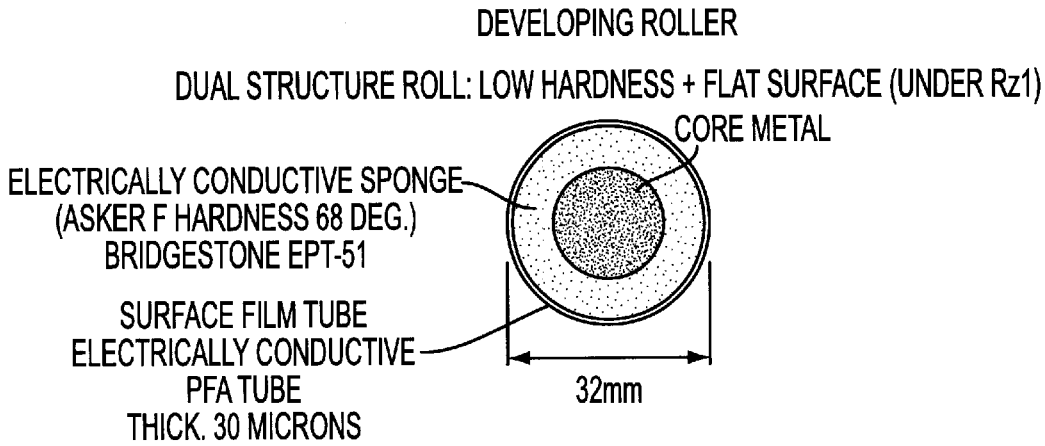
FIG. 17 shows an example of an elastic roller used as the developing roller.
Figure 17B:
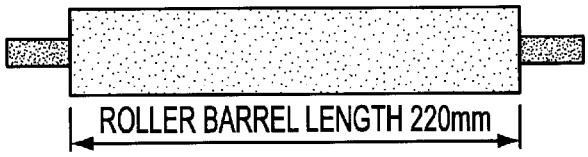
Figure 18A:
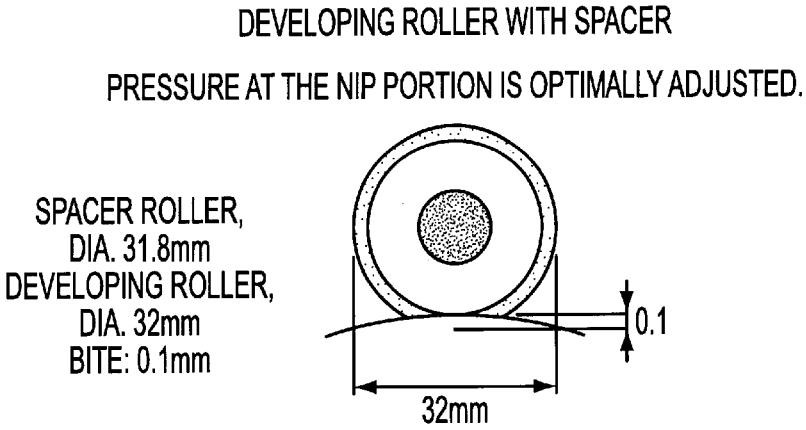
FIG. 18 shows another example of the elastic roller.
Figure 18B:
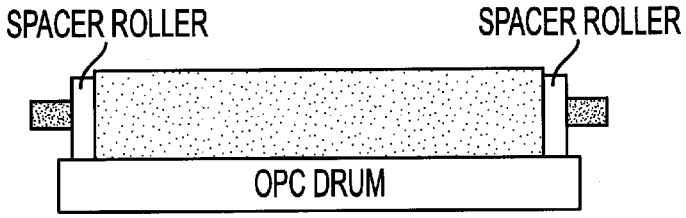
Figure 22A:
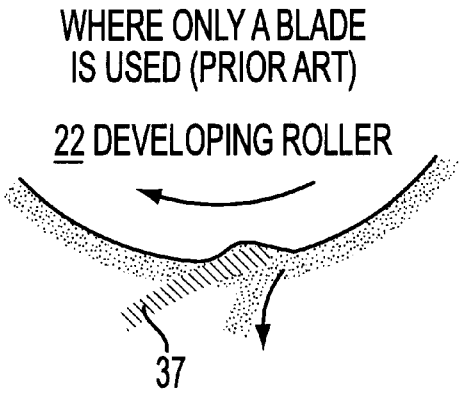
FIG. 22 is a diagram of assistance in explaining why the reverse scraping roller can scrap the residual toner from a soft developing roller.
Figure 22B:
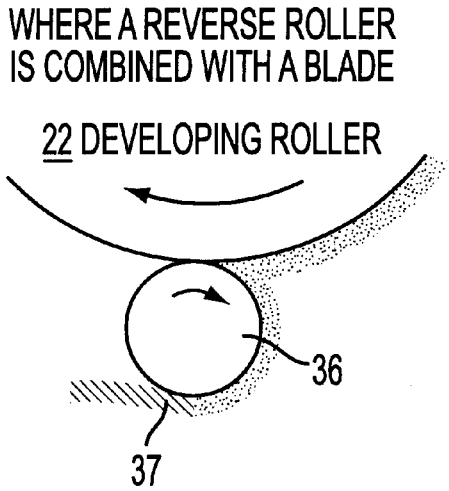

Column 8,
Line 52, change "Fig. 17 shows" to -- FIGS. 17A and 17B show --.
Line 54, change "Fig. 18 shows" to -- FIGS. 18A and 18B show --.
Line 63, change "Fig. 22 is a diagram" to -- FIGS. 22A and 22B are diagrams --.

Column 13,
Line 38, delete "[Table 3]".

Column 16,
Line 43, insert -- ( -- after "roller".

Signed and Sealed this

Third Day of September, 2002

*Attest:*

*Attesting Officer*

JAMES E. ROGAN
*Director of the United States Patent and Trademark Office*